US011316284B2

(12) United States Patent
Cho et al.

(10) Patent No.: US 11,316,284 B2
(45) Date of Patent: Apr. 26, 2022

(54) ELECTRONIC DEVICE INCLUDING ANTENNA MODULE

(71) Applicant: SAMSUNG ELECTRONICS CO., LTD., Suwon-si (KR)

(72) Inventors: Woosik Cho, Suwon-si (KR); Dowan Kim, Suwon-si (KR); Yongsang Yun, Suwon-si (KR); Kyungrok Lee, Suwon-si (KR); Sunghyup Lee, Suwon-si (KR); Wonhyung Heo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 13 days.

(21) Appl. No.: 17/036,313

(22) Filed: Sep. 29, 2020

(65) Prior Publication Data

US 2021/0135378 A1 May 6, 2021

(30) Foreign Application Priority Data

Oct. 30, 2019 (KR) ..... 10-2019-0136783

(51) Int. Cl.
*H01Q 1/22* (2006.01)
*H01Q 21/28* (2006.01)
(Continued)

(52) U.S. Cl.
CPC ..... *H01Q 21/28* (2013.01); *H01Q 1/02* (2013.01); *H01Q 1/243* (2013.01); *H01Q 1/38* (2013.01);
(Continued)

(58) Field of Classification Search
CPC ..... H01Q 21/28; H01Q 1/02; H01Q 1/243; H01Q 1/38; H01Q 1/526; H01Q 21/062;
(Continued)

(56) References Cited

U.S. PATENT DOCUMENTS

2013/0136868 A1 5/2013 Bruck et al.
2015/0123860 A1 5/2015 Park et al.
(Continued)

FOREIGN PATENT DOCUMENTS

KR 10-2015-0111366 10/2015

OTHER PUBLICATIONS

International Search Report and Written Opinion dated Jan. 11, 2021 in corresponding International Application No. PCT/KR2020/012836.

*Primary Examiner* — David E Lotter
(74) *Attorney, Agent, or Firm* — Nixon & Vanderhye, P.C.

(57) ABSTRACT

An electronic device includes: a housing including a front plate, a rear plate disposed opposite the front plate, and a side bezel enclosing at least a portion of a space between the front plate and the rear plate; a display disposed in the space and visible through at least a portion of the front plate, wherein the display includes a first layer including a plurality of pixels; and a second layer disposed at the first layer and including an opening; and an antenna module disposed in the space, wherein the antenna module includes a printed circuit board including a first surface facing away from the first layer through the opening and a second surface facing opposite the first surface; at least one antenna element disposed on the first surface, or inside the printed circuit board closer to the first surface than the second surface; and a communication circuit disposed at the second surface of the printed circuit board, the communication circuit configured to transmit and/or receive signals of a selected or designated frequency band through the at least one antenna element.

20 Claims, 20 Drawing Sheets

(51) Int. Cl.

| | |
|---|---|
| ***H01Q 1/38*** | (2006.01) |
| ***H01Q 1/24*** | (2006.01) |
| ***H01Q 1/02*** | (2006.01) |
| ***H01Q 21/06*** | (2006.01) |
| ***H01Q 1/52*** | (2006.01) |

(52) U.S. Cl.
CPC ..... *H01Q 1/526* (2013.01); *H01Q 21/062* (2013.01); *H01Q 21/065* (2013.01)

(58) Field of Classification Search
CPC . H01Q 21/065; H01Q 1/2283; H04M 1/0249; H04M 1/0266; H04M 1/0277; H04B 1/40
See application file for complete search history.

(56) References Cited

U.S. PATENT DOCUMENTS

| | | | | |
|---|---|---|---|---|
| 2017/0033435 | A1 | 2/2017 | Nakano | |
| 2018/0233808 | A1 | 8/2018 | Noori et al. | |
| 2019/0027808 | A1* | 1/2019 | Mow | H04R 1/025 |
| 2019/0097306 | A1 | 3/2019 | Romano et al. | |
| 2019/0131691 | A1* | 5/2019 | Hong | H01Q 1/2283 |
| 2019/0327834 | A1 | 10/2019 | Kim et al. | |

* cited by examiner

ELECTRONIC DEVICE INCLUDING ANTENNA MODULE

CROSS-REFERENCE TO RELATED APPLICATION

This application is based on and claims priority under 35 U.S.C. § 119 to Korean Patent Application No. 10-2019-0136783, filed on Oct. 30, 2019, in the Korean Intellectual Property Office, the disclosure of which is incorporated by reference herein in its entirety.

BACKGROUND

Field

The disclosure relates to an electronic device including an antenna module.

Description of Related Art

With the development of wireless communication technology, electronic devices (e.g., electronic devices for communication) are commonly used in daily life; thus, content use is increasing. While data traffic rapidly increases, as frequency demand increases, a technology for using a high-frequency band or an ultra-high frequency band (e.g., millimeter wave (mmWave)) that can more easily gradually transmit data for wireless communication is being developed. The electronic device may include a highly directional phase array antenna (e.g., antenna array) in order to appropriately operate in a mobile environment. The electronic device may use a beam forming system that processes a transmission signal or a reception signal so that energy radiated from the phase array antenna is concentrated in a specific direction in a space.

Space may be limited because of characteristics of an electronic device such as a smartphone that should focus on mobility. Recently, because a slimming form factor has been pursued, it is becoming more difficult to dispose an antenna system using millimeter waves crossing a high frequency band in consideration of dependencies and interrelationships between mutually operating components. In the case of the millimeter wave, an antenna system in which a large number of radiating elements are tightly coupled and having a narrow-beam and high-gain is required, but because of propagation characteristics that are high in straightness (e.g., direction) and sensitive to a path loss, coverage (communication range) of the antenna system disposed together with various components and/or structures in the electronic device is limited.

SUMMARY

Embodiments of the disclosure provide an electronic device including an antenna module for extending coverage.

According to various example embodiments of the disclosure, an electronic device includes: a housing including a front plate, a rear plate disposed at a side opposite the front plate, and a side bezel enclosing at least a portion of a space between the front plate and the rear plate; a display disposed in the space and visible through at least a portion of the front plate, wherein the display includes: a first layer including a plurality of pixels; and a second layer disposed at the first layer and including an opening; and an antenna module disposed in the space, wherein the antenna module includes: a printed circuit board including a first surface facing away from the first layer through the opening and a second surface facing opposite the first surface; at least one antenna element disposed on the first surface, or inside the printed circuit board closer to the first surface than the second surface; and a communication circuit disposed at the second surface of the printed circuit board, the communication circuit configured to transmit and/or receive signals of a selected or designated frequency band through the at least one antenna element.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

The following disclosure is made with reference to the accompanying drawings and is provided to assist in a comprehensive understanding of various embodiments of the disclosure. It includes various details to assist in that understanding, but these are to be regarded as merely illustrative non-limiting examples. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following disclosure and claims are not limited to the bibliographical meanings, but, are merely used to enable a clear and consistent understanding of the disclosure. Accordingly, it should be apparent to those skilled in the art that the following description of various embodiments of the disclosure is provided for illustration purpose only and not for the purpose of limiting the disclosure.

It is to be understood that the singular forms "a," "an," and "the" include plural referents unless the context clearly dictates otherwise. Thus, for example, reference to "a component surface" includes reference to one or more of such surfaces.

Figure 1:
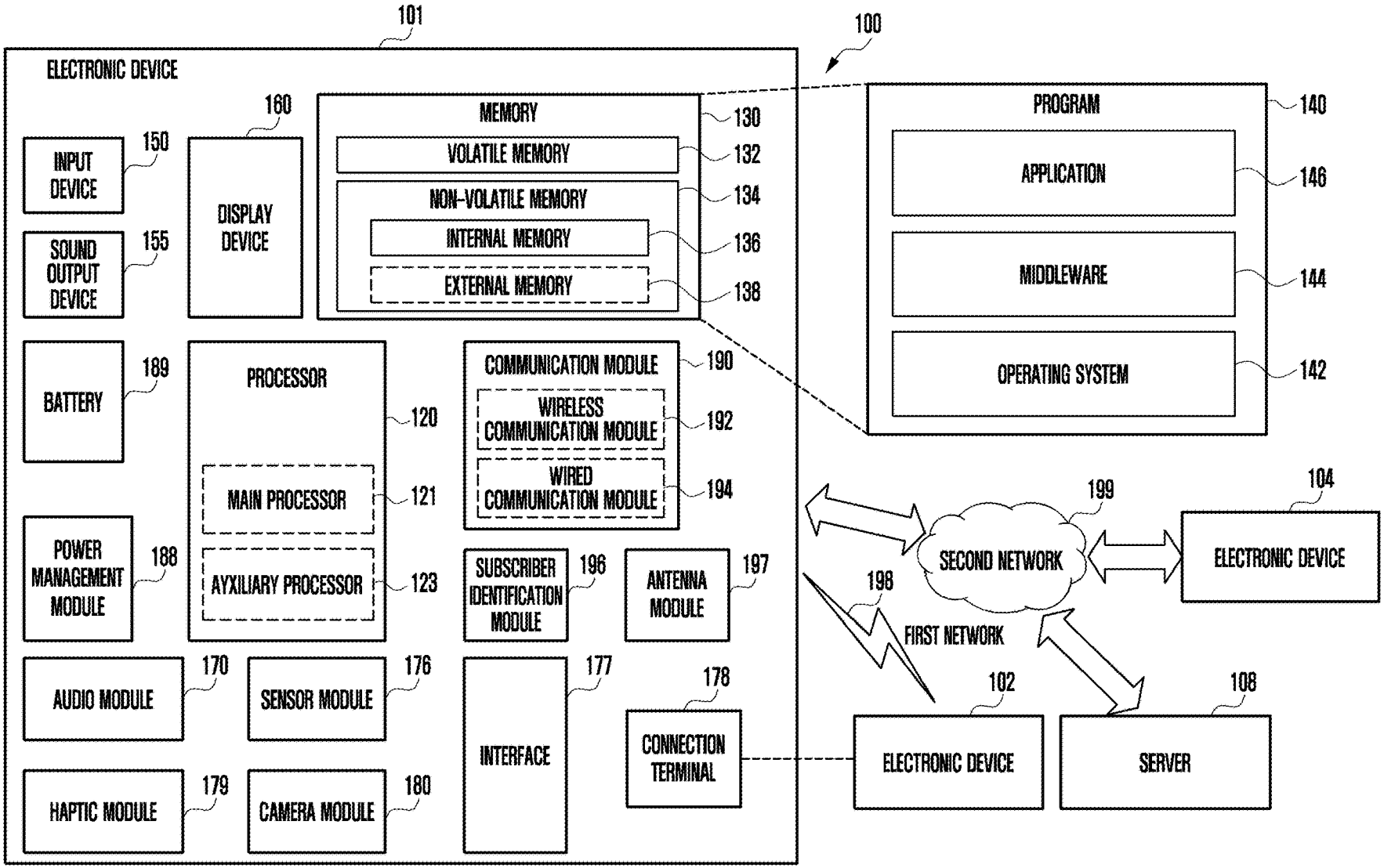
FIG. 1 is a block diagram illustrating an example electronic device in a network environment according to various embodiments of the disclosure.

FIG. 1 illustrates an example electronic device 101 in a network environment 100 according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identity module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134. The non-volatile memory 134 may include an internal memory 136 or external memory 138.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for an incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture a still image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or a standard of the Infrared Data Association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element including a conductive material or a conductive pattern formed in or on a substrate (e.g., a PCB). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include, for example, a portable communication device (e.g., a smart phone), a computer device, a portable multimedia device, a portable medical device, a camera, a wearable device, a home appliance, or the like. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the "non-transitory" storage medium is a tangible device, and may not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may still perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
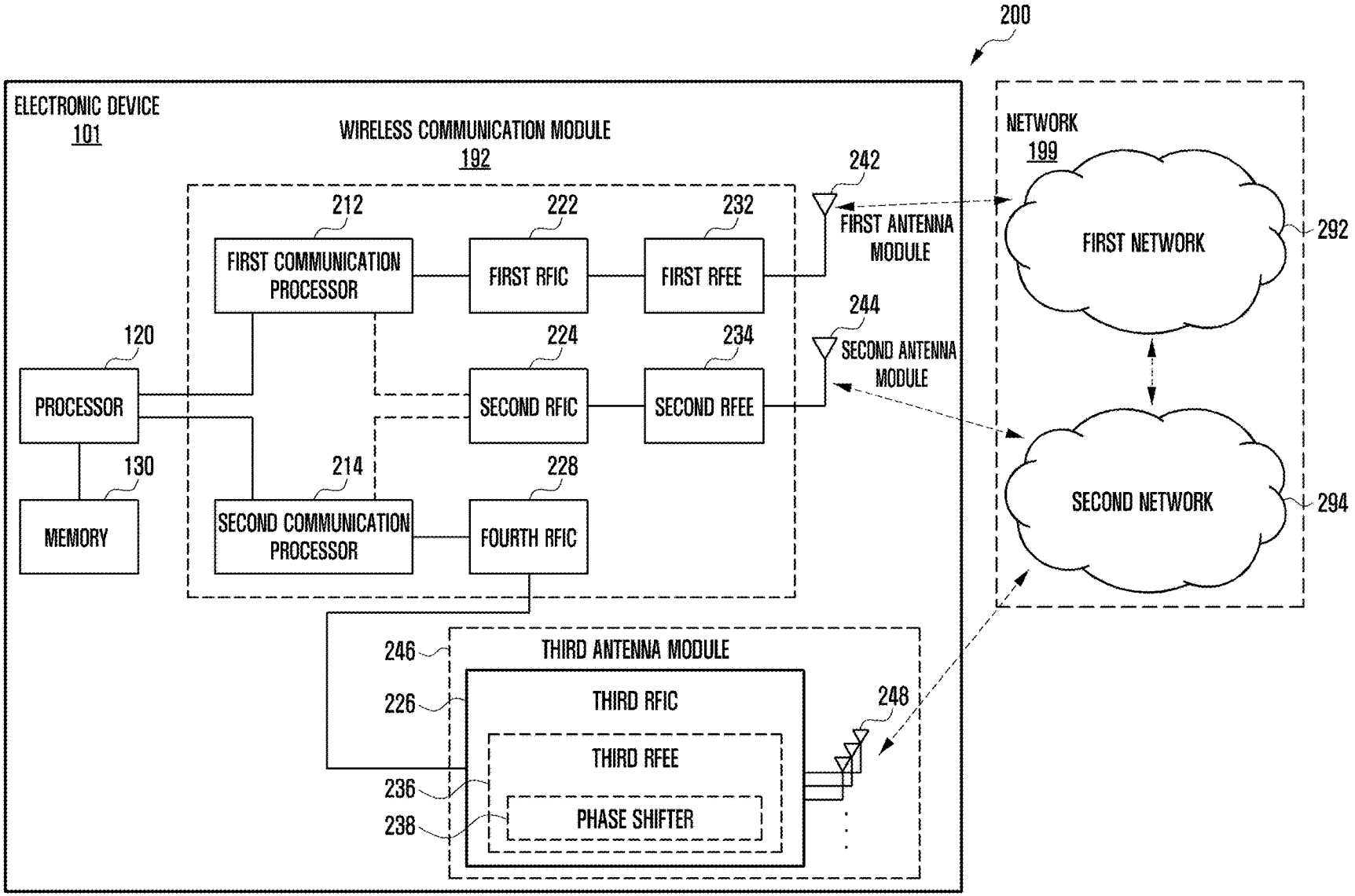
FIG. 2 is a block diagram illustrating an example electronic device for supporting legacy network communication and 5G network communication according to various embodiments of the disclosure.

FIG. 2 is a block diagram illustrating an example electronic device in a network environment including a plurality of cellular networks according to various embodiments of the disclosure.

Referring to FIG. 2, the electronic device 101 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include a processor 120 and a memory 130. A second network 199 may include a first cellular network 292 and a second cellular network 294. According to another embodiment, the electronic device 101 may further include at least one of the components described with reference to FIG. 1, and the second network 199 may further include at least one other network. According to an example embodiment, the first communication processor 212, second communication processor 214, first RFIC 222, second RFIC 224, fourth RFIC 228, first RFFE 232, and second RFFE 234 may form at least part of the wireless communication module 192. According to another embodiment, the fourth RFIC 228 may be omitted or included as part of the third RFIC 226.

The first communication processor 212 may establish a communication channel of a band to be used for wireless communication with the first cellular network 292 and support legacy network communication through the established communication channel. According to various embodiments, the first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. According to various embodiments, the second cellular network 294 may be a 5G network defined in 3GPP. Additionally, according to an embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel. According to an example embodiment, the first communication processor 212 and the second communication processor 214 may be implemented in a single chip or a single package. According to various embodiments, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through the third RFFE 236. The third RFIC 226 may convert the preprocessed 5G Above6 RF signal to a baseband signal so as to be processed by the second communication processor 214. According to an example embodiment, the third RFFE 236 may be formed as part of the third RFIC 226.

According to an embodiment, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to an example embodiment, the first RFIC 222 and the second RFIC 224 may be implemented into at least part of a single package or a single chip. According to an example embodiment, the first RFFE 232 and the second RFFE 234 may be implemented into at least part of a single package or a single chip. According to an example embodiment, at least one of the first antenna module 242 or the second antenna module 244 may be omitted or may be combined with another antenna module to process RF signals of a corresponding plurality of bands.

According to an example embodiment, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to an example embodiment, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 50 radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
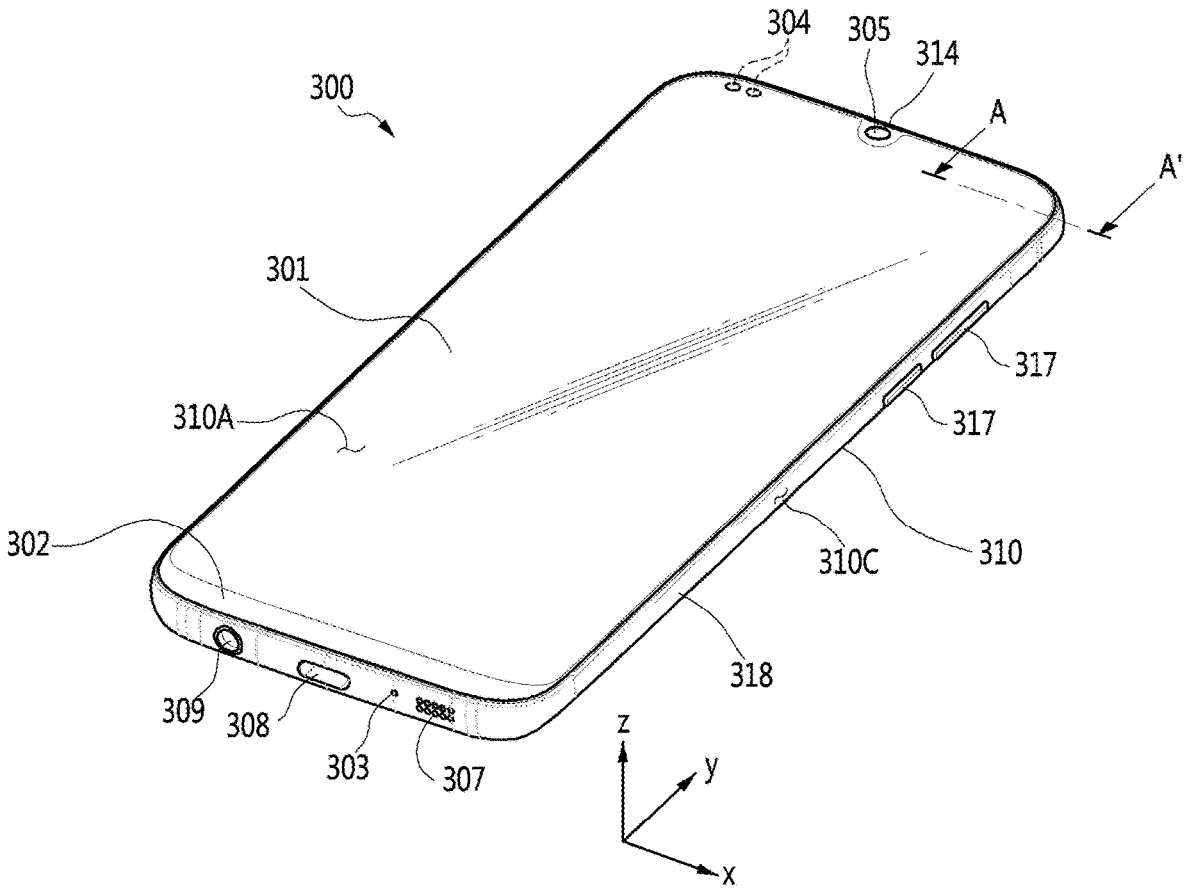
FIG. 3A is a front perspective view of a mobile electronic device according to an embodiment.

FIG. 3A is a front perspective view illustrating a mobile electronic device 300 according to an embodiment of the disclosure.

Figure 3B:
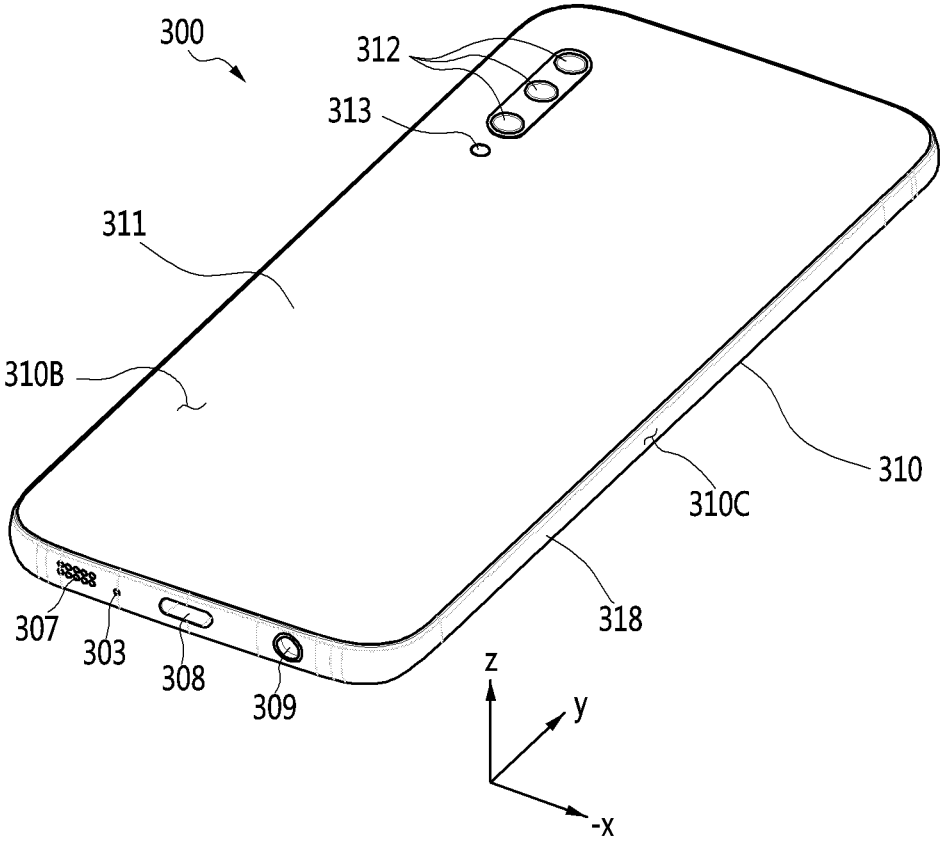
FIG. 3B is a rear perspective view of the electronic device of FIG. 3A according to an embodiment.

FIG. 3B is a rear perspective view illustrating the electronic device 300 of FIG. 3A according to an embodiment of the disclosure.

Referring to FIGS. 3A and 3B, according to an embodiment, an electronic device 300 may include a housing 310 that includes a first surface (or front surface) 310A, a second surface (or rear surface) 310B, and a lateral surface 310C that surrounds a space between the first surface 310A and the second surface 310B. According to another embodiment, the housing 310 may refer to a structure that forms a part of the first surface 310A, the second surface 310B, and the lateral surface 310C. According to an embodiment, the first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or "lateral member") 318 which is combined with the front plate 302 and the rear plate 311 and includes a metal and/or polymer. In some embodiments, the rear plate 311 and the lateral bezel structure 318 may be integrally formed and may be of the same material (e.g., a metallic material such as aluminum).

According to an embodiment, the electronic device 300 may include at least one of a display 301, audio modules 303, 307 and 314, a sensor module 304, camera modules 305, 312 and 313, key input devices 317, and connector holes 308 and 309. In various embodiments, the electronic device 300 may omit at least one (e.g., the key input devices 317) of the above components, or may further include other components (e.g., a fingerprint sensor, or a light emitting device). In various embodiments, the electronic device 300 may include the electronic device 101 of FIG. 1.

The display 301 may be viewable through a substantial portion of the front plate 302, for example. In various embodiments, at least a part of the display 301 may be exposed through the front plate 302 that forms the first surface 310A and the first regions 310D. In various embodiments, outlines (i.e., edges and corners) of the display 301 may have substantially the same form as those of the front plate 302. In another embodiment (not shown), the spacing between the outline of the display 301 and the outline of the front plate 302 may be substantially unchanged in order to enlarge the exposed area of the display 301.

In another embodiment (not shown), a recess or opening may be formed in a portion of a display area of the display 301 to accommodate or to be aligned with at least one of the audio modules (e.g., the audio module 314), the sensor module 304, and the camera module 305. In another embodiment (not shown), at least one of the audio modules (e.g., the audio module 314), the sensor module 304, and the camera module 305 may be disposed on the back of the display area of the display 301. In another embodiment (not shown), the display 301 may be combined with, or adjacent to, a touch sensing circuit, a pressure sensor capable of measuring the touch strength (pressure), and/or a digitizer for detecting a stylus pen.

The audio modules 303, 307 and 314 may correspond to a microphone hole (e.g., the audio module 303) and speaker holes (e.g., the audio modules 307 and 314). The microphone hole may contain a microphone disposed therein for acquiring external sounds and, in a case, contain a plurality of microphones to sense a sound direction. The speaker holes may be classified into an external speaker hole and a call receiver hole. In various embodiments, the microphone hole and the speaker holes may be implemented as a single hole, or a speaker (e.g., a piezo speaker) may be provided without the speaker holes.

The sensor module 304 may generate electrical signals or data corresponding to an internal operating state of the electronic device 300 or to an external environmental condition. The sensor module 304 may include, for example, a proximity sensor, and the proximity sensor may generate signals regarding a proximity of an external object based on lights passed through some part of the first surface 310A of the housing 310. According to another embodiment, the sensor module 304 may include, for example, a biometric sensor (e.g., a fingerprint sensor) that detect biometric data based on lights passed through some part of the first surface 310A of the housing 310. According to various embodiments, the fingerprint sensor may be disposed on the second surface 310B of the housing 310. The electronic device 300 may further include at least one of a gesture sensor, a gyro sensor, an air pressure sensor, a magnetic sensor, an acceleration sensor, a grip sensor, a color sensor, an infrared (IR) sensor, a temperature sensor, a humidity sensor, or an illuminance sensor (e.g., the sensor module 304).

The camera modules 305, 312 and 313 may include a first camera device (e.g., the camera module 305), a second camera device (e.g., the camera module 312) and/or a flash (e.g., the camera module 313). The first camera device may generate, for example, image signals based on lights passed through some part of the first surface 310A of the housing 310. The second camera device and the flash may be disposed on the second surface 310B of the electronic device 300. The camera module 305 or the camera module 312 may include one or more lenses, an image sensor, and/or an image signal processor. The flash may include, for example, a light emitting diode or a xenon lamp. In various embodiments, two or more lenses (infrared cameras, wide angle and telephoto lenses) and image sensors may be disposed on one side of the electronic device 300.

The key input devices 317 may be disposed on the lateral surface 310C of the housing 310. In another embodiment, the electronic device 300 may not include some or all of the key input devices 317 described above, and the key input devices 317 which are not included may be implemented in another form such as a soft key on the display 301. In various embodiments, the key input devices 317 may include a sensor module (not shown) disposed on the second surface 310B of the housing 310.

The light emitting device (not shown) may be disposed on the first surface 310A of the housing 310, for example. For example, the light emitting device may provide status information of the electronic device 300 in an optical form. In various embodiments, the light emitting device may provide a light source associated with the operation of the camera module 305. The light emitting device may include, for example, a light emitting diode (LED), an infrared (IR) LED, or a xenon lamp.

The connector holes 308 and 309 may include a first connector hole (e.g., the connector hole 308) adapted for a connector (e.g., a universal serial bus (USB) connector) for transmitting and receiving power and/or data to and from an external electronic device, and/or a second connector hole (e.g., the connector hole 309) adapted for a connector (e.g., an earphone jack) for transmitting and receiving an audio signal to and from an external electronic device.

Figure 4:
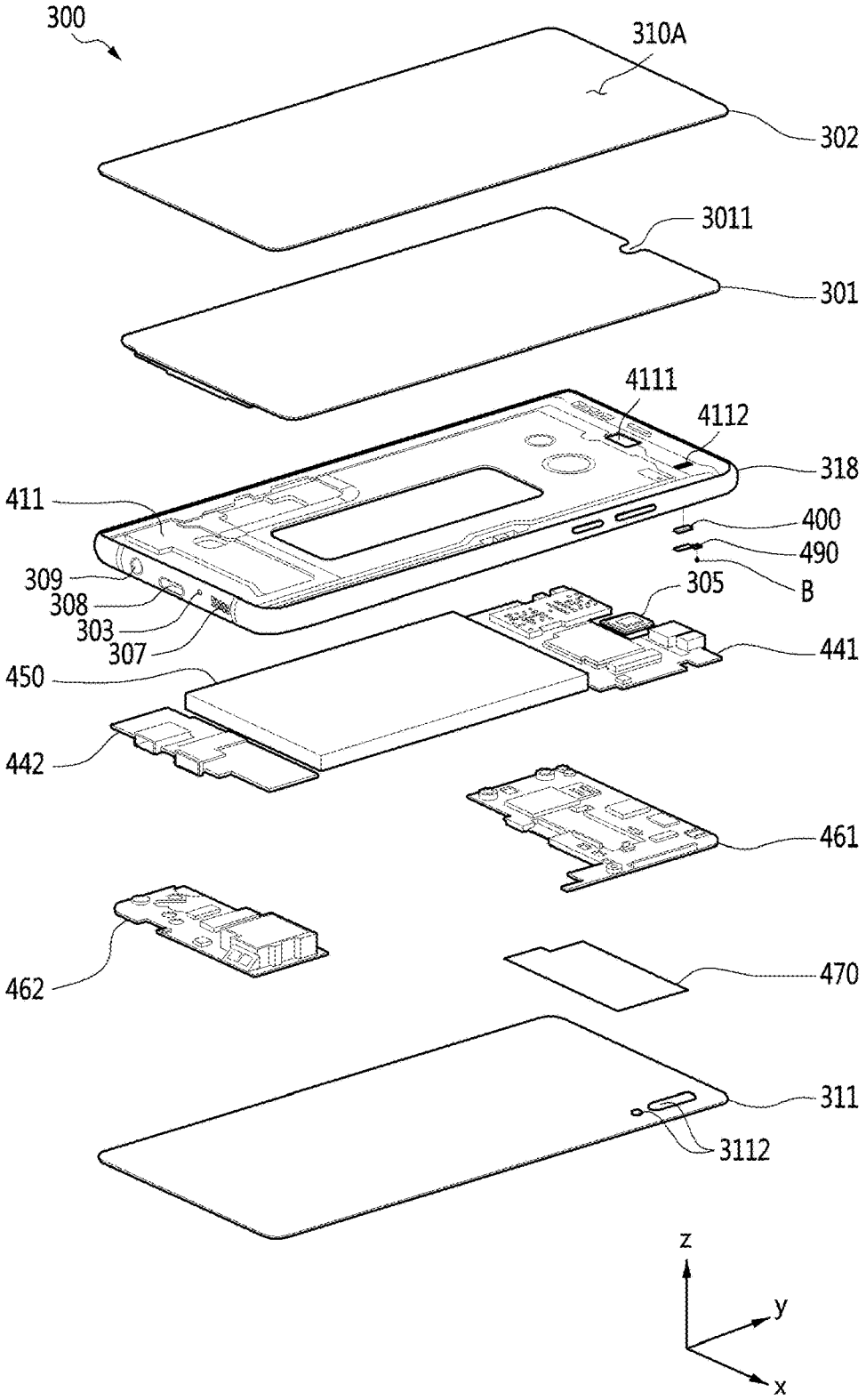
FIG. 4 is an exploded perspective view illustrating the electronic device of FIG. 3A according to an embodiment.

FIG. 4 is an exploded perspective view illustrating the electronic device 300 of FIG. 3A according to an embodiment.

Referring to FIG. 4, according to an embodiment, the electronic device 300 may include a side bezel structure 318, first support member 411 (e.g., bracket), front plate 302, display 301, first substrate assembly 441, second substrate assembly 442, battery 450, third support member 461, fourth support member 462, antenna structure 470, and/or rear plate 311. In some embodiments, the electronic device 300 may omit at least one (e.g., the third support member 461 or the fourth support member 462) of the components or may additionally include other components. At least one of the components of the electronic device 300 may be the same as or similar to at least one of the components of the electronic device 300 of FIG. 3A or 3B, and repeated descriptions may not be repeated below.

The first support member 411 may be disposed inside, for example, the electronic device 300 to be connected to the side bezel structure 318 or may be formed integrally with the side bezel structure 318. The first support member 411 may be made of, for example, a metal material and/or a non-metal material (e.g., polymer). According to an example embodiment, the first support member 411 may include a conductive portion and a non-conductive portion connected to the conductive portion. The conductive portion and the side bezel structure 318 may be integrally formed and include the same material. The non-conductive portion may be formed in a form coupled with the conductive portion through, for example, insert injection. According to various embodiments, the side bezel structure 318 may include a plurality of segmented portions (not illustrated). The non-conductive portion may be extended to the plurality of segmented portions to form a portion of the side surface 310C (see FIG. 3A or 3B).

The display 301 may be coupled to one surface of, for example, the first support member 411 and be disposed between the first support member 411 and the front plate 302. The first substrate assembly 441 and the second substrate assembly 442 may be coupled to, for example, the other surface of the first support member 411 and be disposed between the first support member 411 and the rear plate 311.

According to an example embodiment, the first substrate assembly 441 may include a second printed circuit board (PCB) (not illustrated). The display 301 or the first camera device 305 may be electrically connected to the second printed circuit board through various electrical paths such as a flexible printed circuit board (FPCB). The first substrate assembly 441 may include various electronic components electrically connected to the second printed circuit board. The electronic component may be disposed at the second printed circuit board or may be electrically connected to the second printed circuit board through an electrical path such as a cable or an FPCB. The electronic component may include, for example, at least some of the components included in the electronic device 101 of FIG. 1.

According to various embodiments, when viewed from above the rear plate 311, the first substrate assembly 441 may include a main PCB, a slave PCB disposed to partially overlap the main PCB, and/or an interposer substrate between the main PCB and the slave PCB.

According to an example embodiment, when viewed from above the front plate 302, the second substrate assembly 442 may be spaced apart from the first substrate assembly 441 with the battery 450 interposed therebetween. The second substrate assembly 442 may include a third printed circuit board electrically connected to the second printed circuit board of the first substrate assembly 441. The second substrate assembly 442 may include various electronic components electrically connected to the third printed circuit board. The electronic component may be disposed at a third printed circuit board or may be electrically connected to the third printed circuit board through an electrical path such as a cable or an FPCB. The electronic component may include, for example, some of the components included in the electronic device 101 of FIG. 1. According to an embodiment, the electronic component may be a USB connector using a first connector hole 308, an earphone jack using a second connector hole 309, a microphone using a microphone hole 303, or a speaker using a speaker hole 307.

According to an embodiment, the battery 450 may be disposed between the first support member 411 and the rear plate 311 and be coupled to the first support member 411. The battery 450 is a device for supplying power to at least one component of the electronic device 300 and may include, for example, a non-rechargeable primary cell, a rechargeable secondary cell, or a fuel cell. At least a portion of the battery 450 may be disposed, for example, on substantially the same plane as a second printed circuit board of the first substrate assembly 441 or a third printed circuit board of the second substrate assembly 442. The battery 450 may be integrally disposed inside the electronic device 300 or may be detachably disposed at the electronic device 300.

According to an example embodiment, the third support member 461 may be disposed between the first support member 411 and the rear plate 311 and be coupled to the first support member 411 through a fastening element such as a bolt. At least a portion of the first substrate assembly 441 may be disposed between the first support member 411 and the third support member 461, and the third support member 461 may cover and protect the first substrate assembly 441.

According to an embodiment, when viewed from above the front plate 302, the fourth support member 462 may be spaced apart from the third support member 461 with the battery 450 interposed therebetween. The fourth support member 462 may be disposed between the first support member 411 and the rear plate 311 and be coupled to the first support member 411 through a fastening element such as a bolt. At least a portion of the second substrate assembly 442 may be disposed between the first support member 411 and the fourth support member 462, and the fourth support member 462 may cover and protect the second substrate assembly 442.

According to an example embodiment, the third support member 461 and/or the fourth support member 462 may be made of a metal material and/or a non-metal material (e.g., polymer). According to various embodiments, the third support member 461 and/or the fourth support member 462 may be referred to as a rear case.

According to an embodiment, the antenna structure 470 may be disposed between the third support member 461 and the rear plate 311. The antenna structure 470 may be implemented in a film form of, for example, an FPCB. According to an embodiment, the antenna structure 470 may include at least one conductive pattern used as a loop type radiator. For example, the at least one conductive pattern may include a planar helical conductive pattern (e.g., flat coil or pattern coil).

According to an embodiment, the conductive pattern of the antenna structure 470 may be electrically connected to a wireless communication circuit (e.g., the wireless communication module 192 of FIG. 1) disposed at the first substrate assembly 441. For example, the conductive pattern may be used for short-range wireless communication such as near field communication (NFC). As another example, the conductive pattern may be used in magnetic secure transmission (MST) for transmitting and/or receiving magnetic signals.

According to various embodiments, the conductive pattern of the antenna structure 470 may be electrically connected to a power transmission/reception circuit disposed at the first substrate assembly 441. The power transmission/reception circuit may wirelessly receive power from an external electronic device through a conductive pattern or wirelessly transmit power to the external electronic device. The power transmission/reception circuit may include a power management integrated circuit (PMIC) or a charger integrated circuit (IC) included in the power management module 188 of FIG. 1, and charge a battery 450 using power received through a conductive pattern.

According to an example embodiment, the display 301 may include an opening 3011 formed in at least a partial area corresponding to an optical sensor (e.g., a first camera device 305 or a biological sensor) disposed inside the electronic device 300. The opening 3011 may be formed in, for example, a notch form. According to some embodiments, the opening 3011 may be implemented in the form of a through hole. The first support member 411 may include an opening 4111 positioned to correspond to the opening 3011 of the display 301. The optical sensor may receive external light through the opening 3011 of the display 301, the opening 4111 of the first support member 411, and some areas of the front plate 302 aligned therewith. According to various embodiments (not illustrated), the opening 3011 of the display 301 may be replaced to be implemented into a substantially transparent area formed by changing a pixel structure and/or a wiring structure.

According to an example embodiment, the rear plate 311 may include an opening 3112 for exposing and disposing the second camera device 312 and the flash 313 included in the first substrate assembly 441 to the rear surface 310B.

According to an embodiment, the electronic device 300 may include an antenna module 400. The antenna module 400 may include, for example, the third antenna module 246 of FIG. 2. The antenna module 400 may be disposed near a rear surface (e.g., one surface of the display 301 facing the first support member 411) of the display 301. The antenna module 400 may transmit and/or receive radio waves by radiating energy toward a first surface (or front surface) 310A, thereby securing coverage toward the first surface 310A.

According to an example embodiment, the display 301 may include a first layer including a plurality of pixels and a second layer coupled with the first layer between the first layer and the first support member 411. The first layer may include, for example, a light emitting layer including a plurality of pixels implemented with a light emitting element such as an organic light emitting diode (OLED). The second layer may serve to support and protect the first layer, to shield light, to absorb or shield electromagnetic waves, or to diffuse, disperse, or dissipate a heat.

According to an example embodiment, when viewed from above the first surface (or front surface) 310A, a second layer of the display 301 may include a first opening (not illustrated) at least partially overlapping the antenna module 400. The antenna module 400 may face away from the first layer of the display 301 through the first opening. The antenna module 400 may transmit and/or receive radio waves by radiating energy toward the first surface 310A through the first layer of the display 301 and the front plate 302.

According to an example embodiment, when viewed from above the first surface 310A, the first support member 411 may include a second opening 4112 at least partially overlapping a first opening of a second layer included in the display 301. The antenna module 400 may face away from the first layer of the display 301 through the second opening 4112.

According to an example embodiment, the antenna module 400 may be disposed at or coupled to a second support member 490. The second support member 490 may be coupled to the first support member 411 through a fastening element such as a bolt B. Because of coupling of the first support member 411 and the second support member 490, the antenna module 400 disposed at the second support member 490 may be disposed at the second opening 4112 of the first support member 411.

According to various embodiments, the second support member 490 may be made of a heat transfer material. The second support member 490 may serve as a heat spreader that diffuses or disperses a heat radiated from the antenna module 400.

According to various embodiments, the second support member 490 may be connected to a heat dissipation structure (e.g., heat spreader or heat pipe) disposed between the first support member 411 and the rear plate 311 or at various other locations. A heat dissipated from the antenna module 400 may be moved to the heat spreader or the heat pipe through the second support member 490.

Figure 5:
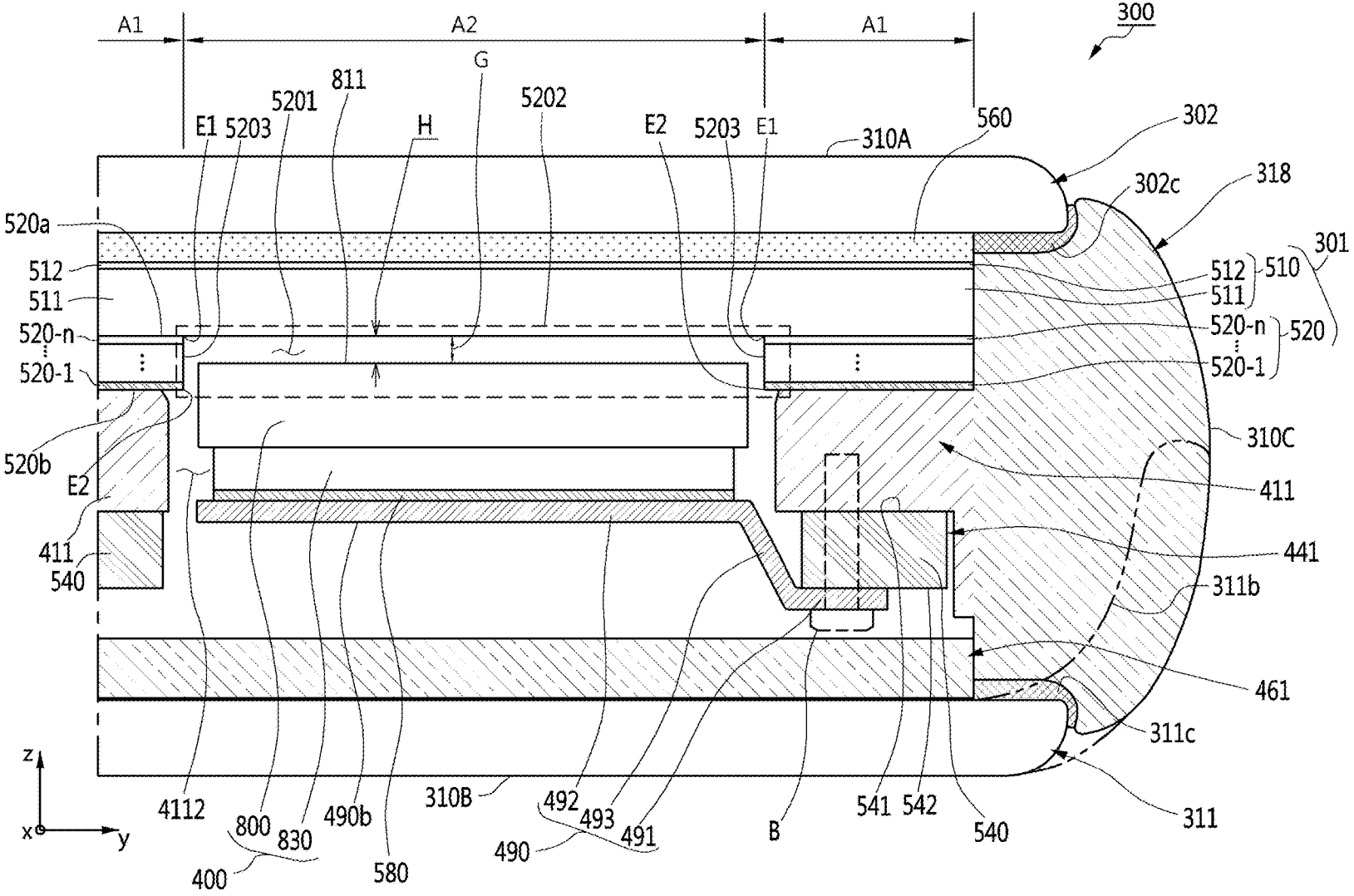
FIG. 5 is a cross-sectional view taken along line A-A' in the electronic device of FIG. 3A according to an embodiment.

FIG. 5 is a cross-sectional view taken along line A-A' in the electronic device 300 of FIG. 3A according to an embodiment.

Referring to FIG. 5, in an example embodiment, the electronic device 300 may include a front plate 302, rear plate 311, side member (e.g., side bezel) 318, first support member 411, third support member 461, display 301, antenna module 400, first substrate assembly 441, and/or second support member 490. According to various embodiments, at least one of the components of the electronic device 300 illustrated in FIG. 5 may be the same as or similar to at least one of the components of FIG. 4, and repeated descriptions may be omitted.

According to an example embodiment, an edge (not illustrated) of the front plate 302 may be coupled to the side member 318 through various adhesive members 302*c* such as a double-sided tape. An edge (not illustrated) of the rear plate 311 may be coupled to the side member 318 through various adhesive members 311*c* such as a double-sided tape. The first support member 411, the third support member 461, the display 301, the antenna module 400, the first substrate assembly 441, and the second support member 490 may be disposed in an internal space of the housing (e.g., the housing 310 of FIG. 3A) formed with the front plate 302, the rear plate 311, and the side member 318.

According to an embodiment, the display 301 may be disposed between the first support member 411 and the front plate 302 and be coupled to the front plate 302. An optical transparent adhesive member 560 such as an optical clear adhesive (OCA) may be disposed between the front plate 302 and the display 301. According to an example embodiment, the front plate 302 and the display 301 may be coupled without an air gap through the optical transparent adhesive member 560. The optical transparent adhesive member 560 may improve an image quality. For example, when it is assumed that there is an air gap between the front plate 302 and the display 301, because of the difference in refractive index between different media (e.g., the front plate 302, the air gap, and the display 301), some of the light output from the display 301 may not move straight to the front plate 302 but be reflected and lost. The loss of light because of the air gap blurs an image through the screen (e.g., an effective area capable of representing an image in the device formed with the display 301 and the front plate 302) to cause deterioration of the image quality. When the air gap between the front plate 302 and the display 301 is filled with the optical transparent adhesive member 560, the difference in refractive index between the optical transparent adhesive member 560 and a medium layer in contact therewith may be minimized and/or reduced. When the difference in refractive index between the optical transparent adhesive member 560 and the medium layer in contact therewith is minimized and/or reduced, reflectivity of an interface between the optical transparent adhesive member 560 and the medium layer in contact therewith may be lowered. When reflectivity of the interface between the optical transparent adhesive member 560 and the medium layer in contact therewith is lowered, reflection at the interface and a loss of light by the reflection may be reduced; thus, a clear image may be expressed through the screen.

According to an embodiment, the display 301 may include a first layer 510 and a second layer 520 bonded to the first layer 510. An adhesive member (not illustrated) of various polymers may be disposed between the first layer 510 and the second layer 520. The optical transparent adhesive member 560 may be disposed between the front plate 302 and the first layer 510. The first layer 510 may be disposed between the optical transparent adhesive member 560 and the second layer 520.

According to an embodiment, the first layer 510 may include a light emitting layer 511. The light emitting layer 511 may include a plurality of pixels implemented into a light emitting element such as an OLED. An area in which a plurality of pixels is disposed may form a screen, which is an effective area capable of representing an image. The light emitting layer 511 may include at least one thin film transistor (TFT) for controlling a plurality of pixels. The at least one TFT may control a current of the light emitting element to adjust on or off of the pixel or brightness of the pixel. The at least one TFT may be implemented into, for example, an amorphous silicon (a-Si) TFT or a low-temperature polycrystalline silicon (LTPS) TFT. The light emitting layer 511 may include a storage capacitor, and the storage capacitor may maintain a voltage signal in the pixel, maintain a voltage entering the pixel within one frame, or reduce a change in a gate voltage of the TFT by a leakage current during a light emission time. By a routine (e.g., initialization, data write) that controls at least one TFT, the storage capacitor may maintain a voltage applied to the pixel at regular time intervals.

According to an embodiment, the first layer 510 may include an optical layer 512 disposed between the light emitting layer 511 and the optical transparent adhesive member 560. An optical transparent adhesive member (not illustrated) such as an OCA may be disposed between the light emitting layer 511 and the optical layer 512. The optical layer 512 may improve a picture quality of the screen.

According to an example embodiment, the optical layer 512 may include a phase retardation layer (or retarder) and a polarizing layer (or polarizer) disposed between the phase retardation layer and the front plate 302. When unpolarized light, such as sunlight, passes through the front plate 302 and the optical transparent adhesive member 560 and enters the display 301, the unpolarized light may pass through the polarization layer and be converted to linearly polarized light, and the linearly polarized light may pass through the phase retardation layer and be changed into circularly polarized light. For example, when unpolarized light passes through a 90° polarization layer, the unpolarized light may be converted to 90° linearly polarized light, and when 90° linearly polarized light passes through a 45° phase retardation layer, the 90° linearly polarized light may be converted to circularly polarized light in which a polarization axis rotates. The phase retardation layer may have characteristics of a quarter wave retarder (λ/4 retarder). For example, when sunlight passes through the front plate 302 and the optical transparent adhesive member 560 and enters the display 301, most of the sunlight may be reflected from a metal such as an electrode included in the light emitting layer 511 and this may make it difficult for the user to recognize the screen. According to an embodiment, the polarization layer and the phase retardation layer may prevent and/or reduce light entered from the outside from being reflected, thereby improving outdoor visibility. For example, light of the circularly polarized light changed by the phase retarder layer having a quarter wave retarder (λ/4 retarder) property may be reflected from the light emitting layer 511, and the reflected light of the circularly polarized light may occur total λ/2 phase delay while again passing through the phase retardation layer to be converted to linearly polarized light perpendicular to initial 90° polarization. The 180° linearly polarized light cannot be radiated to the outside through the 90° polarization layer. According to various embodiments, one layer in which a polarization layer and a phase retardation layer are combined may be provided, and this layer may be defined as a circular polarization layer'.

According to an embodiment, the second layer 520 may include a plurality of layers 520-1, . . . , **520-*n* (n≥2) for various functions. An adhesive member (not illustrated) of various polymers may be disposed between the plurality of layers 520-1, . . . , 520-*n*. Some of the plurality of layers 520-1, . . . , 520-*n* included in the second layer 520 may be protected from an external impact while supporting the first layer 510 and include, for example, a flexible layer such as an emboss layer, a cushion layer, or a buffer layer. Some of the plurality of layers 520-1, . . . , 520-*n* included in the second layer 520 may shield external light or light generated in the first layer 510. Some (e.g., 520-1) of the plurality of layers 520-1, . . . , 520-*n* included in the second layer 520 may absorb or shield electromagnetic waves and be made of various conductive materials (e.g., copper (Cu)). Some (e.g., 520-1) of the plurality of layers 520-1, . . . , 520-*n* included in the second layer 520 may diffuse, disperse, or dissipate a heat and include, for example, a copper sheet or a graphite sheet. The second layer 520** may include various layers having various other functions.

According to various embodiments (not illustrated), the display 301 may include a touch sensing circuit (e.g., touch sensor). The touch sensing circuit may be implemented into a transparent conductive layer (or film) based on various conductive materials such as indium tin oxide (ITO). According to an example embodiment, the touch sensing circuit may be disposed between the front plate 302 and the optical layer 512 (e.g., add-on type). According to another embodiment, the touch sensing circuit may be disposed between the optical layer 512 and the light emitting layer 511 (e.g., on-cell type). According to another embodiment, the light emitting layer 511 may include a touch sensing circuit or a touch sensing function (e.g., in-cell type).

According to various embodiments (not illustrated), the first layer 510 may be formed based on an OLED, and include an encapsulation layer disposed between the light emitting layer 511 and the optical layer 512. Electrodes and organic materials that emit light in the OLED may be very sensitive to oxygen and/or moisture to lose luminescence properties. According to an embodiment, the encapsulation layer may seal the light emitting layer 511 so that oxygen and/or moisture do/does not penetrate the OLED.

According to various embodiments, the display 301 may be implemented as a flexible display based on a substrate (e.g., plastic substrate) made of a flexible material such as polyimide (PI). The flexible display may be formed based on an OLED, and the encapsulation layer may be implemented with, for example, thin-film encapsulation (TFE). According to various embodiments, the flexible display may include a conductive pattern such as a metal mesh (e.g., aluminum metal mesh) as a touch sensing circuit disposed at the encapsulation layer and the optical layer 512. For example, the metal mesh may have durability larger than that of a transparent conductive layer implemented with ITO to correspond to bending of the flexible display.

According to various embodiments (not illustrated), the display 301 may further include a pressure sensor capable of measuring the intensity (pressure) of the touch.

Figure 6:
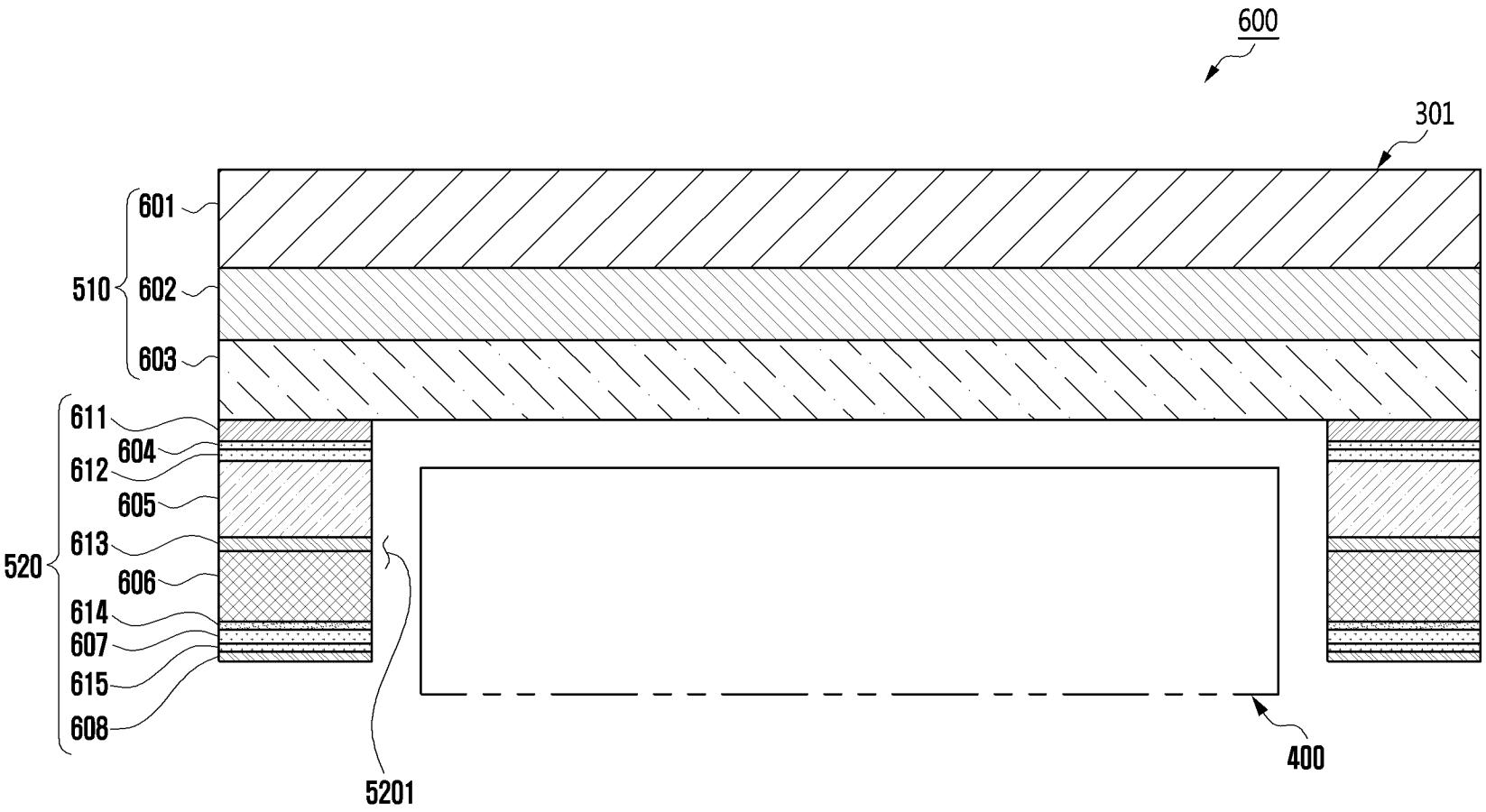
FIG. 6 is a cross-sectional view illustrating a structure including a display and an antenna module of FIG. 5 according to an embodiment.

FIG. 6 is a cross-sectional view illustrating a structure 600 including a display 301 and an antenna module 400 of FIG. 5 according to an embodiment.

Referring to FIGS. 5 and 6, the first layer 510 of the display 301 may include a touch sensing circuit 601, a polarization layer 602 (e.g., the optical layer 512 of FIG. 5), and a panel 603 (e.g., the light emitting layer 511 of FIG. 5). The polarization layer 602 may be disposed between the touch sensing circuit 601 and the panel 603. The second layer 520 of the display 301 may include an emboss layer 604, cushion layer 605, digitizer 606, graphite sheet 607, or copper sheet 608 based on a polyester (PET) film sequentially disposed in a −z axis direction. Adhesive materials 611, 612, 613, 614, and 615 of various polymers may be disposed between the panel 603 and the emboss layer 604, between the emboss layer 604 and the cushion layer 605, between the cushion layer 605 and the digitizer 606, between the digitizer 606 and the graphite sheet 607, or between the graphite sheet 607 and the copper sheet 608. The digitizer 606 may be an electromagnetic induction panel for sensing a magnetic field type stylus pen. According to various embodiments, a plurality of layers included in the first layer 510 or the second layer 520, and a stacking structure or a stacking order thereof may be various. According to various embodiments, some (e.g., the digitizer 606) of the plurality of layers of the display 301 may be omitted.

According to an embodiment, a thickness of the touch sensing circuit 601 may be about 0.15 mm. A thickness of the polarization layer 602 may be about 0.104 mm. A thickness of the panel 603 may be about 0.118 mm. A thickness of the emboss layer 604 may be about 0.007 mm. A thickness of the cushion layer 605 may be 0.122 mm. A thickness of the digitizer 606 may be about 0.1125 mm. A thickness of the graphite sheet 607 may be about 0.025 mm. A thickness of the copper sheet 608 may be about 0.012 mm. The adhesive material 611 between the panel 603 and the emboss layer 604 may be formed in a thickness of about 0.038 mm. The adhesive material 612 between the emboss layer 604 and the cushion layer 605 may be formed in a thickness of about 0.015 mm. The adhesive material 613 between the cushion layer 605 and the digitizer 606 may be formed in a thickness of about 0.025 mm. The adhesive material 614 between the digitizer 606 and the graphite sheet 607 may be formed in a thickness of about 0.008 mm. The adhesive material 615 between the graphite sheet 607 and the copper sheet 608 may be formed in a thickness of about 0.008 mm. According to various embodiments, layers included in the display 301 may be formed in various different thicknesses. According to various embodiments, the display 301 may omit some of the plurality of layers or may additionally include other layers.

According to an embodiment, the second layer 520 of the display 301 may include a first opening 5201. The antenna module 400 may be inserted and disposed in the first opening 5201 of the second layer 520. The antenna module 400 may be disposed at a separation distance from the first layer 510.

According to various embodiments (not illustrated), the display 301 may further include various components according to a provision form thereof. These components may be variously changed according to the convergence trend of the display 301, but components equivalent to the above-mentioned components may be further included in the display 301. According to various embodiments, the display 301 may exclude specific components from the above-described components or replace specific components with other components according to a provided form thereof.

According to an embodiment, the second layer 520 may include a first opening 5201. For example, the first opening 5201 may be formed in the form of a through hole. Because of the first opening 5201, the display 301 may include a recess 5202 of a dug shape in a direction toward the front plate 302 from the rear plate 311.

According to an example embodiment, the second layer 520 may include a third surface 520*a* bonded to the first layer 510 and a fourth surface 520*b* disposed at the side opposite to that of the third surface 520*a* and substantially parallel to the third surface 520*a*. The first opening 5201 may include a first edge E1 formed at the third surface 520*a*, a second edge E2 formed at the fourth surface 520*b*, and an inner side surface 5203 connecting the first edge E1 and the second edge E2. According to an example embodiment, when viewed from above the front plate 302, the second layer 520 may be disposed not to overlap a first surface 811 of the antenna module 400, and the first opening 5201 may be formed by the second layer 520. According to an example embodiment, when viewed from above the front plate 302, the first edge E1 may form a rectangle. When viewed from above the rear plate 311, the second edge E2 may form a rectangle overlapping the first edge E1. The inner side surface 5203 may be perpendicular to the third surface 520*a* or the fourth surface 520*b*. The recess 5202 may be a rectangular parallelepiped space. According to various embodiments, according to a shape of the antenna module 400, the first edge E1, the second edge E2, and the inner side surface 5203 or the recess 5202 may be implemented in various forms.

According to an embodiment, the antenna module 400 may include an antenna structure 800 including a first printed circuit board in which an antenna array (e.g., the antenna 248 of FIG. 2) is disposed. The antenna structure 800 may include an antenna array disposed on the first surface 811, or inside the first printed circuit board closer to the first surface 811 than a second surface of the first printed circuit board opposite the first surface 811. The first surface 811 may not overlap the second layer 520 of the display 301 because of the first opening 5201 when viewed from above the front plate 302. The first opening 5201 prevents and/or avoids a conductive material included in the second layer 520 from facing the antenna array disposed on the first surface 811 or near the first surface 811, thereby reducing a decrease in radiation performance.

According to various embodiments (not illustrated), the first opening 5201 may be formed to be narrowed in a direction (e.g., the z-axis direction) toward the front plate 302 from the rear plate 311 when viewed in an yz cross-section. For example, the inner side surface 5203 may be formed in an inclined surface forming an acute angle with respect to the third surface 520*a* and an obtuse angle with respect to the fourth surface 520*b*. For another example, the inner side surface 5203 may be implemented in a step shape.

According to various embodiments, when viewed from above the front plate 302, the second layer 520 may be variously disposed not to overlap the first surface 811 of the antenna module 400, and the first opening 5201 formed therefrom is not limited to a through-hole shape and may indicate a space in which the second layer 520 is not disposed between the first layer 510 and the first support member 411. This will be described in greater detail below with reference to FIGS. 7A, 7B and 7C.

Figure 7A:
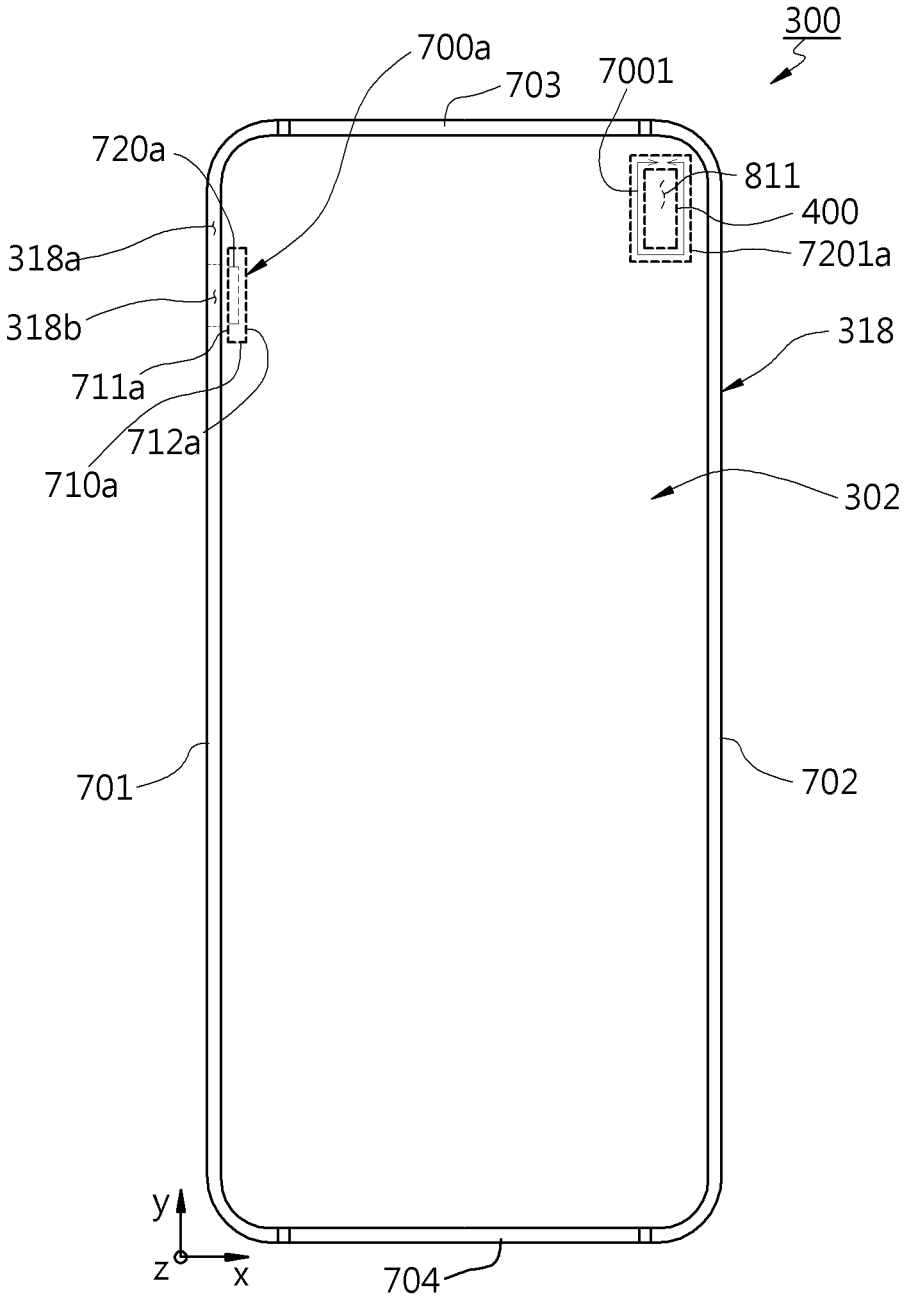
FIGS. 7A, 7B, and 7C are plan views illustrating the electronic device of FIG. 3A viewed from above a front plate according to an embodiment.
Figure 7B:
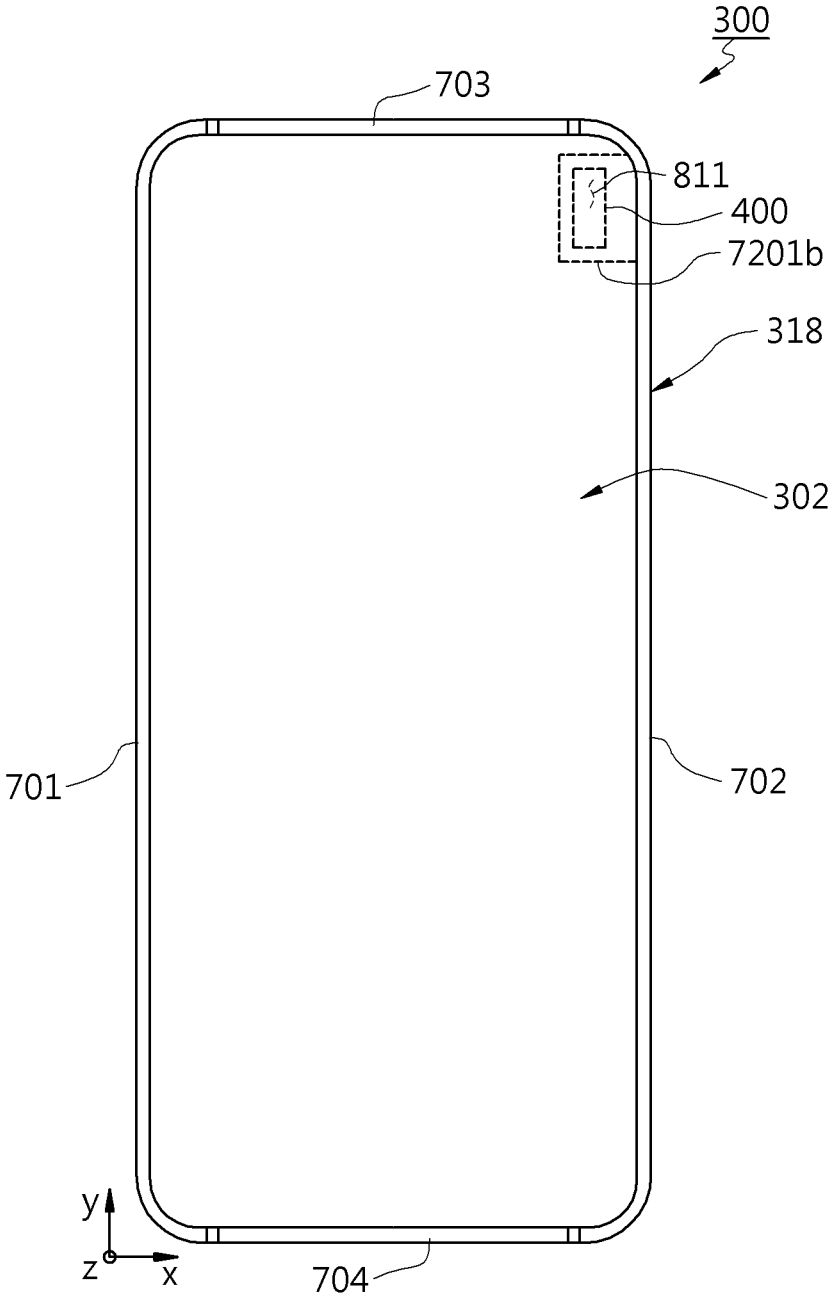
Figure 7C:
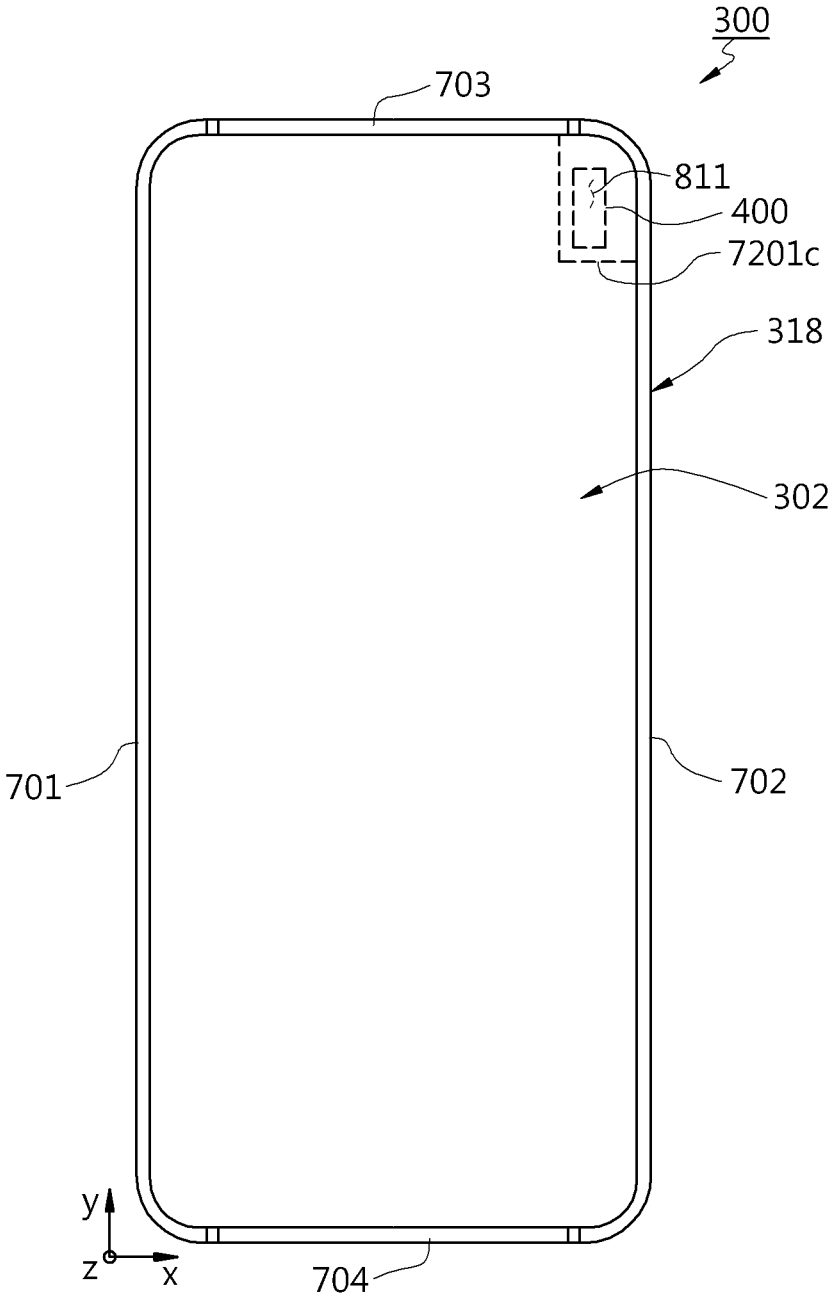

FIGS. 7A, 7B, and 7C are plan views illustrating the electronic device of FIG. 3A viewed from above the front plate 302 according to an embodiment.

Referring to FIG. 7A, 7B, or 7C, in an example embodiment, the side member (e.g., bezel) 318 may include a first side portion 701, second side portion 702, third side portion 703, or fourth side portion 704. The first side portion 701 and the second side portion 702 may be disposed at opposite sides and parallel to each other. The third side portion 703 and the fourth side portion 704 may be disposed at opposite sides and parallel to each other. The third side portion 703 may be perpendicular to the first side portion 701 (or the second side portion 702) and connect one end portion of the first side portion 701 and one end portion of the second side portion 702. The fourth side portion 704 may be perpendicular to the first side portion 701 (or the second side portion 702) and connect the other end portion of the first side portion 701 and the other end portion of the second side portion 702. According to various embodiments, a distance between the first side portion 701 and the second side portion 702 may be less than that between the third side portion 703 and the fourth side portion 704.

According to an embodiment, when viewed from above the front plate 302, the antenna module 400 may be disposed to overlap a screen (e.g., an effective area or an active area capable of representing an image in the device formed with the display 301 and the front plate 302 of FIG. 5).

According to an embodiment, when viewed from above the front plate 302, the antenna module 400 may be disposed closer to the second side portion 702 than the first side portion 701. When viewed from above the front plate 302, the antenna module 400 may be disposed closer to the third side portion 703 than the fourth side portion 704. For example, the antenna module 400 may be disposed near a corner connecting the second side portion 702 and the third side portion 703.

Referring to FIGS. 5 and 7A, when viewed from above the front plate 302, the first opening 5201 formed in the second layer 520 of the display 301 may be implemented in the form of a through hole 7201*a*. When viewed from above the front plate 302, the first surface 811 of the antenna module 400 may be disposed inside the through hole 7201*a*.

Referring to FIGS. 5 and 7B, when viewed from above the front plate 302, the first opening 5201 formed in the second layer 520 of the display 301 may be implemented in the form of a notch 7201*b*. The notch 7201*b* has, for example, a partially dug form in an −x axis direction (e.g., a direction advancing from the second side portion 702 to the first side portion 701) from an edge of the second layer 520 adjacent to the second side portion 702, and the edge thereof may be defined to a U-cut having a 'U' shape. According to some embodiments, the notch may be formed in a partially dug form in a −y axis direction from the edge of the second layer 520 adjacent to the third side portion 703 (e.g., a direction advancing from the third side portion 703 to the fourth side portion 704). When viewed from above the front plate 302, the first surface 811 of the antenna module 400 may be disposed inside the notch 7201*b*.

Referring to FIGS. 5 and 7C, when viewed from above the front plate 302, the first opening 5201 formed in the second layer 520 of the display 301 may be implemented into an L-cut 7201*c* having an edge of an 'L' shape. When viewed from above the front plate 302, the first surface 811 of the antenna module 400 may be disposed inside the L-cut 7201*c*.

According to various embodiments, the antenna module 400 is not limited to the embodiments of FIG. 7A, 7B, or 7C and may be disposed at various other positions, and a first opening formed in the second layer 520 of the display 301 may also be implemented in various forms.

Figure 8:
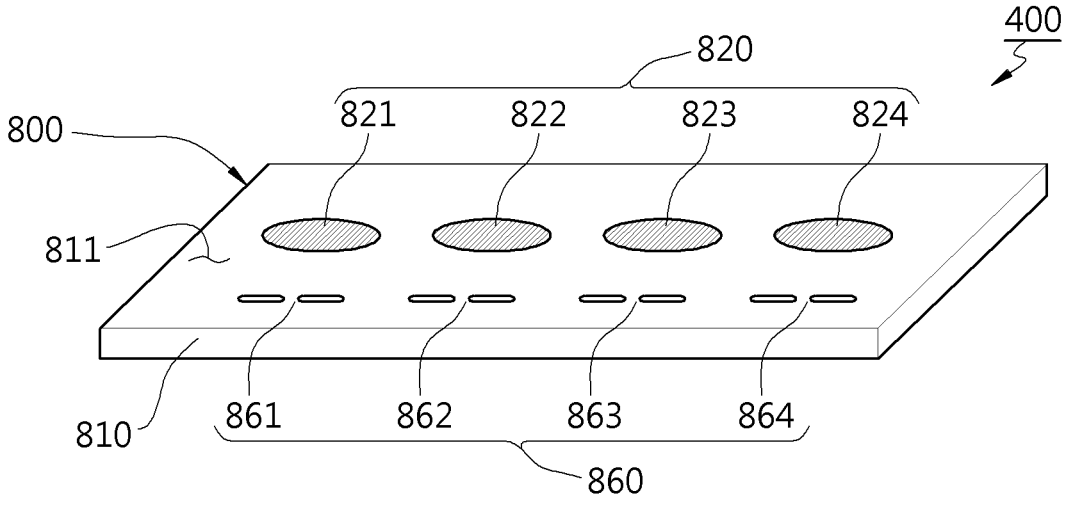
FIGS. 8 and 9 are perspective views illustrating an antenna module according to an embodiment.
Figure 9:
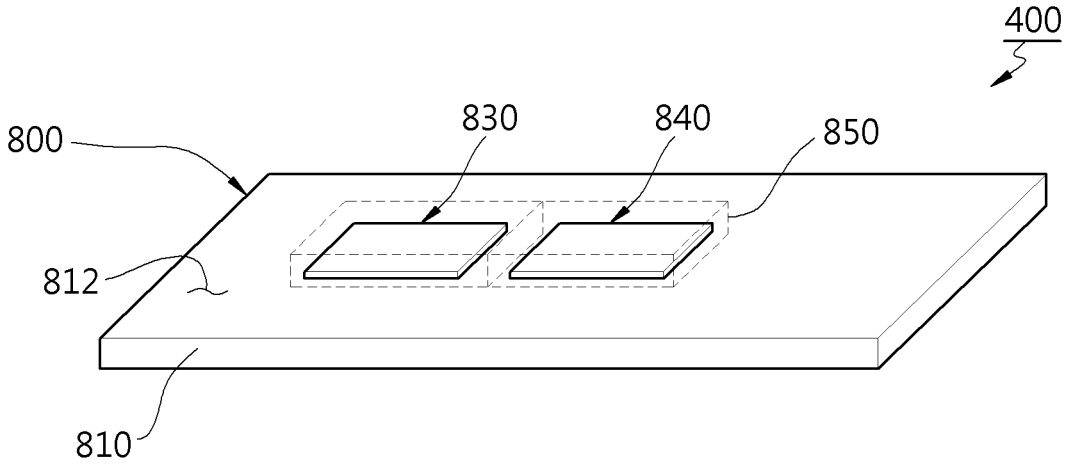

FIGS. 8 and 9 are perspective views illustrating an antenna module according to an embodiment.

Referring to FIGS. 5, 8, and 9, in an example embodiment, the antenna module 400 may include an antenna structure 800, a first wireless communication circuit 830, and/or a first power management circuit 840. The antenna module 400 may be, for example, the third antenna module 246 of FIG. 2.

According to an embodiment, the antenna structure 800 may include a first printed circuit board 810 in which an antenna array 820 is disposed. The first printed circuit board 810 may include a first surface 811 and a second surface 812 disposed at the side opposite to that of the first surface 811. The antenna array 820 may include a plurality of antenna elements 821, 822, 823, and 824 disposed on the first surface 811, or inside the first printed circuit board 810 closer to the first surface 811 than the second surface 812. The plurality of antenna elements 821, 822, 823, and 824 may be, for example, the antenna 248 of FIG. 2.

According to an embodiment, the plurality of antenna elements 821, 822, 823, and 824 may have substantially the same shape and be disposed at regular intervals. The first printed circuit board 810 may include a plurality of conductive layers (e.g., a plurality of conductive pattern layers) and a plurality of non-conductive layers (e.g., insulating layers) alternately stacked with the plurality of conductive layers. The plurality of antenna elements 821, 822, 823, and 824 may be implemented into, for example, at least a portion of the plurality of conductive layers. According to various embodiments, the number or location of antenna elements included in the antenna array 820 may be various without being limited to the example illustrated in FIG. 8.

According to an embodiment, the plurality of antenna elements 821, 822, 823, and 824 may operate as a patch antenna. According to various embodiments (not illustrated), the plurality of antenna elements may be implemented into a dipole antenna or a loop antenna. According to various embodiments, the antenna structure 800 may further include an antenna array 860 including a plurality of antenna elements 861, 862, 863, and 864 operating as a dipole antenna. The plurality of antenna elements 861, 862, 863, and 864 may be disposed on the first surface 811, or inside the first printed circuit board 810 closer to the first surface 811 than the second surface 812. The plurality of antenna elements 861, 862, 863, and 864 may be disposed in pairs with a plurality of antenna elements 821, 822, 823, and 824 operating as a patch antenna.

According to an example embodiment, the first wireless communication circuit 830 may be disposed at the second surface 812 of the first printed circuit board 810 through a conductive bonding member such as a solder. The first wireless communication circuit 830 may be electrically connected to the plurality of antenna elements 821, 822, 823, and 824 through wirings (e.g., an electrical pattern formed with a conductive pattern or via) included in the first printed circuit board 810. According to an embodiment, the first wireless communication circuit 830 may be a radio frequency integrated circuit (RFIC) (e.g., the third RFIC 226 of FIG. 2).

According to an embodiment, the plurality of antenna elements 821, 822, 823, and 824 may be fed directly from the first wireless communication circuit 830, and operate as an antenna radiator.

According to another embodiment, the plurality of antenna elements 821, 822, 823, and 824 may be used as dummy elements (e.g., a dummy antenna or a dummy patch, or a conductive patch). The dummy element may be physically separated from other conductive elements to be in an electrically floating state. When viewed toward the first surface 811, the first printed circuit board 810 may include a plurality of second antenna elements (not illustrated) at least partially overlapping the plurality of antenna elements 821, 822, 823, and 824 and physically separated from the plurality of antenna elements 821, 822, 823, and 824. When viewed toward the first surface 811, the plurality of second antenna elements may have substantially the same shape as that of the plurality of antenna elements 821, 822, 823, 824. According to some embodiments, when viewed above the first surface 811, the plurality of antenna elements 821, 822, 823, and 824 may have a shape different from that of the plurality of second antenna elements. The plurality of second antenna elements may be electrically connected to the first wireless communication circuit 830 and operate as a feeding portion (or feeding pattern) for indirectly feeding the plurality of antenna elements 821, 822, 823, and 824. The plurality of antenna elements 821, 822, 823, and 824 may be electromagnetically coupled with a plurality of second antenna elements electrically connected to the first wireless communication circuit 830 to operate as an antenna radiator or to adjust radiation characteristics. For example, the plurality of antenna elements 821, 822, 823, and 824 may move a resonance frequency of the antenna structure 800 to a specified frequency or by a specified phase. For example, the plurality of antenna elements 821, 822, 823, and 824 may extend a bandwidth capable of transmitting or receiving a signal through the antenna structure 800 or form different frequency bands (e.g., multi-band).

According to an embodiment, the antenna structure 800 may include a ground plane (or ground layer) (not illustrated) implemented into at least some of a plurality of conductive layers included in the first printed circuit board 810. The ground plane may be disposed between the antenna array 820 and the second surface 812, and overlap at least partially the antenna array 820 when viewed toward the first surface 811. The ground plane may be electrically connected to the first wireless communication circuit 830 through an electrical path formed with vias and/or conductive patterns included in the first printed circuit board 810. The ground plane may be related to radiation characteristics of the antenna array 820. For example, the radiation characteristics of the antenna array 820 may be determined based on a distance in which a plurality of antenna elements 821, 822, 823, and 824 are spaced apart from the ground plane. For example, the radiation characteristics of the antenna array 820 may be determined based on a shape (e.g., width, length, thickness) of the ground plane. For example, the radiation characteristics of the antenna array 820 may be determined based on an insulating material (e.g., dielectric constant) between the plurality of antenna elements 821, 822, 823, and 824 and the ground plane. The ground plane may shield or reduce electromagnetic noise of a signal or power flow in the first printed circuit board 810.

According to an example embodiment, the first power management circuit 840 may be disposed at the second surface 812 of the first printed circuit board 810 through a conductive bonding member such as a solder. The first power management circuit 840 may be electrically connected to various other elements (e.g., connectors, passive elements) disposed at the first wireless communication circuit 830 or the first printed circuit board 810 through wirings (e.g., an electrical path formed with a conductive pattern or via) included in the printed circuit board 810. According to an embodiment, the first power management circuit 840 may be a power management integrated circuit (PMIC).

According to various embodiments, the antenna module 400 may further include a shielding member 850 disposed at the second surface 812 so as to enclose at least one of the first wireless communication circuit 830 or the first power management circuit 840. The shielding member 850 may electromagnetically shield the first wireless communication circuit 830 and/or the first power management circuit 840. For example, the shielding member 850 may include a conductive member such as a shield can. For another example, the shielding member 850 may include a protective member such as a urethane resin and conductive paint such as EMI paint applied to an outer surface of the protective member. According to various embodiments, the shielding member 850 may be implemented into various shielding sheets disposed to cover the second surface 812.

According to various embodiments (not illustrated), the antenna module 400 may further include a frequency adjustment circuit disposed at the first printed circuit board 810. The radiation characteristics and impedance of the antenna array 820 may be related to an antenna performance, and be various according to a shape and size of the antenna element and a material of the antenna element. The radiation characteristics of the antenna element may include an antenna radiation pattern (or antenna pattern), which is a directional function representing a relative distribution of power radiated from the antenna element, and a polarization state (or antenna polarization) of radio waves radiated from the antenna element. The impedance of the antenna element may be related to power transfer from the transmitter to the antenna element or power transfer from the antenna element to the receiver. In order to minimize and/or reduce reflection at a connection portion between the transmission line and the antenna element, the impedance of the antenna element may be designed to match the impedance of the transmission line, thereby enabling efficient signal transmission or maximum power transmission (or minimizing and/or reducing power loss) through the antenna element. Impedance matching may lead to efficient signal flow at a specific frequency (or resonant frequency). Impedance mismatching may reduce a power loss or transmitting/receiving signals to degrade a communication performance. According to an embodiment, a frequency adjustment circuit (e.g., tuner or passive element) disposed at the first printed circuit board 810 may solve such impedance mismatching. According to an embodiment, the frequency adjustment circuit may move a resonant frequency of the antenna to a specified frequency or move a resonant frequency of the antenna by a predetermined amount.

Referring to FIG. 5, in an example embodiment, the first surface 811 of the antenna module 400 may be disposed to face the first layer 510 of the display 301 through the first opening 5201 of the second layer 520. According to an embodiment, the first surface 811 of the antenna module 400 may be spaced apart from the first layer 510 with an air gap G. The first surface 811 and the first layer 510 may be disposed substantially parallel. The air gap G may reduce deformation or distortion of a beam pattern formed from the antenna module 400 or may enable to secure coverage (communication range) toward the front plate 302. The antenna module 400 may have directivity to concentrate electromagnetic energy in a specific direction or to transmit and receive waves. For example, by the beamforming system, the antenna array 820 of FIG. 8 may form a beam in which energy is relatively much radiated in a direction (e.g., +z axis direction) in which the first surface 811 faces. When the first surface 811 is disposed without the air gap G, deformation or distortion of a beam pattern formed from the antenna array 820 may occur. Deformation or distortion of the beam pattern may degrade a coverage (communication range) performance toward the front plate 302. When the first surface 811 or the antenna array 820 is not spaced apart from the first layer 510, a radiation performance may be degraded because of the dielectric constant and/or electrical conductivity of the first layer 510 of the display 301.

The following table illustrates a radiation performance of the antenna module 400 according to a height of the air gap G in the electronic device 300 of FIG. 5 according to an embodiment.

| | 28 Ghz | | | | 39 Ghz | | | |
|---|---|---|---|---|---|---|---|---|
| | Return Loss | | Peak Gain | | Return Loss | | Peak Gain | |
| Height H of air gap G | Vertical polarization | Horizontal polarization | Vertical polarization | Horizontal polarization | Vertical polarization | Horizontal polarization | Vertical polarization | Horizontal polarization |
| 0.4 mm | −9.2 | −9.8 | 9.5 | 9.8 | −4.2 | −4.8 | 8.9 | 9 |
| 0.6 mm | −12.5 | −11.6 | 10 | 10.9 | −6.3 | −6.7 | 10.3 | 10.4 |
| 0.7 mm | −13.8 | −12 | 10.1 | 11.1 | −7.8 | −9 | 11.1 | 11.4 |
| 0.8 mm | −14.6 | −12.6 | 10.1 | 11.1 | −7.9 | −8.7 | 11.3 | 11.1 |
| 0.85 mm | −14.5 | −13 | 10.1 | 11.1 | −7.8 | −8.4 | 11.5 | 11 |

In an example embodiment, referring to FIG. 5, radio waves radiated from the antenna module 400 toward the front plate 302 may include horizontal polarization and vertical polarization as double polarization. Referring to FIG. 5 and the above table, when a signal having a use frequency (e.g., 28 GHz or 39 GHz) is transmitted or received through the antenna module 400, a radiation performance of vertical polarization and/or horizontal polarization may vary according to a height H of the air gap G. According to an embodiment, when considering a power loss (e.g., return loss) and/or an antenna gain (e.g., peak gain), in the embodiment of FIG. 5, the air gap G is formed in about 0.7 mm; thus, a radiation performance at a use frequency may be secured. According to various embodiments, the air gap G for securing a radiation performance of the antenna module 400 may be variously formed based on various conditions such as a configuration of the antenna module 400 or a configuration of the display 301. According to various embodiments, the air gap G may be implemented into a minimum in a range that secures a radiation performance of a used frequency to contribute to slimming of a structure (e.g., the structure 600 of FIG. 6) formed with the display 301 and the antenna module 400.

Referring to FIG. 5, in various embodiments, when a height (or thickness) H of the air gap G is not within a threshold range, deformation or distortion of a beam pattern formed from the antenna array 820 may occur. For example, when the height (or thickness) H of the air gap G is not within a threshold range, electromagnetic coupling occurs between a conductive material included in the second layer 520 of the display 301 and the antenna array 820 of the antenna structure 800; thus, deformation or distortion of the beam pattern may occur. The height H of the air gap G may be formed to electromagnetically isolate the antenna array 820 of the antenna structure 800 and the conductive material included in the second layer 520 of the display 301. According to an embodiment, the height H of the air gap G may be formed to be spaced apart a corresponding distance or more from a conductive material in which the antenna array 820 is included in the second layer 520 of the display 301 based on a wavelength of the antenna module 400.

According to various embodiments, surface waves guided through the display 301 may be generated by radio waves radiated from the antenna array 820 of the antenna module 400. The display 301 is a waveguide in which radio waves radiated from the antenna array 820 of the antenna module 400 flow and may be, for example, a path of a medium that enables radio waves to flow using total reflection properties. The beamforming system may be set such that a corresponding beam pattern is formed through the antenna array 820 of the antenna module 400, but surface waves guided to the display 301 may cause deformation (or distortion) of the beam pattern or may reduce beam coverage (communication range). For example, surface waves may cause a power loss, which may degrade an antenna radiation performance. For example, at least a portion of the electromagnetic field formed from the antenna array 820 of the antenna module 400 may be reflected from the display 301, and a reflected component thereof may cause compensation and/or interference in a maximum boresight (e.g., a direction of a main lobe) to cause deformation (or distortion) of the beam pattern. It may be difficult to secure beam coverage by deformation or distortion of a beam pattern due to surface waves. According to an embodiment, referring to FIGS. 5 and 7A, when viewed from above the front plate 302, because of the through hole 7201*a* of FIG. 7A (e.g., the first opening 5201 of FIG. 5), a conductive material included in the second layer 520 of the display 301 may at least enclose the antenna module 400 (see reference numeral 7001). For example, the conductive material may have a structure enclosing a portion of a side surface or a rear surface of the antenna module. A structure in which a material having a dielectric constant and/or electrical conductivity of the second layer 520 at least encloses the antenna module 400 because of the first opening 5201 reduces surface waves guided to the display 301 to reduce deterioration of a radiation performance. A structure in which a material having a dielectric constant and/or electrical conductivity of the second layer 520 at least encloses the antenna module 400 because of the first opening 5201, radio waves radiated from the antenna module 400 may be abandoned or leaked to the display 301 to reduce or suppress flowing surface waves, thereby reducing deformation or distortion of the beam pattern; thus, an antenna gain and beam coverage may be secured. According to an embodiment, a structure in which a material having a dielectric constant and/or electrical conductivity of the second layer 520 because of the first opening 5201 at least encloses the antenna module 400 may change boundary conditions of propagation to the display 301 to reduce distortion or distortion of radio waves. A structure in which a material having a dielectric constant and/or electrical conductivity of the second layer 520 at least encloses the antenna module 400 because of the first opening 5201 may operate as a wave trap for suppressing surface waves or reducing disturbance waves. A structure in which a material having a dielectric constant and/or electrical conductivity of the second layer 520 at least encloses the antenna module 400 because of the first opening 5201 may operate as a reflector that increases radiation in the maximum boresight.

According to some embodiments, a height H of the air gap G may be formed to enable electromagnetic coupling between the antenna array 820 of an antenna structure 800 and a conductive material (e.g., electrodes included in the light emitting layer 511) included in the first layer 510 of the display 301. The height H of the air gap G may be formed based on a wavelength of radio waves radiated from the antenna structure 800 such that the antenna array 820 of the antenna structure 800 and the conductive material included in the first layer 510 of the display 301 is not electromagnetically isolated. At least a portion of the conductive material included in the first layer 510 electromagnetically coupled to the antenna array 820 of the antenna structure 800 may operate as an antenna radiator. The conductive material included in the first layer 510 may operate as an additional antenna radiator to improve a radiation performance.

According to various embodiments (not illustrated), a material having a dielectric constant that does not substantially affect a radiation performance of the antenna module 400 may be disposed between the first layer 510 of the display 301 and the first surface 811 of the antenna module 400. According to various embodiments, a radiation performance of the antenna module 400 may be degraded, but a material having a dielectric constant that does not deteriorate to a preset value or less may be disposed between the first layer 510 of the display 301 and the first surface 811 of the antenna module 400. In this case, there may be substantially no air gap G between the first layer 510 of the display 301 and the first surface 811 of the antenna module 400. The material may be a low dielectric constant sheet. According to various embodiments, the low dielectric constant sheet may be implemented with various adhesive materials capable of bonding the first surface 811 of the antenna structure 800 and the first layer 510 of the display 301.

According to various embodiments, the low dielectric constant sheet may perform smooth heat dissipation while securing radiation efficiency. The low dielectric constant sheet may be made of a material that can rapidly diffuse or disperse a heat as a heat spreader. For example, the low dielectric constant sheet may have thermal conductivity of about 10 W/mK or more.

According to an example embodiment, the low dielectric constant sheet may be variously formed based on a ceramic material. For example, the ceramic material may include boron nitride (BN) (thermal conductivity: 60 W/mK, dielectric constant: 3.9), aluminum nitride (AlN) (thermal conductivity: 200 W/mK, dielectric constant: 8.5), beryllium oxide (BeO) (thermal conductivity: 340 W/mK, dielectric constant: 6.8), alumina ($Al_2O_3$) (thermal conductivity: 36 W/mK, dielectric constant: 9.5), or silicon carbide (SiC) (thermal conductivity: 270 W/mK, dielectric constant: 40).

According to various embodiments, the low dielectric constant sheet may be a polymer sheet based on a ceramic filler (e.g., BN, AlN, $Al_2O_3$).

According to various embodiments, the low dielectric constant sheet may be formed by processing a ceramic raw material (e.g., BN, AlN, $Al_2O_3$) in a sheet form.

According to various embodiments, the low-dielectric constant sheet may be a sheet using a low dielectric coating filler.

According to various embodiments, the low dielectric constant sheet may be formed by combining 90% of boron nitride (BN) having a relative dielectric constant of 4 and 10% of a rubber binder having a relative dielectric constant of 2%. According to various embodiments, a low dielectric constant sheet based on various other materials may be provided.

According to an example embodiment, according to a height H of the air gap G formed in consideration of a radiation performance of the antenna module 400, the antenna structure 800 may be inserted at least partially into the recess 5202 formed in the display 301 because of the first opening 5201. For example, the first surface 811 of the antenna module 400 may be disposed inside the recess 5202. According to some embodiments, the antenna structure 800 may not be inserted into the recess 5202 according to the height H of the air gap G formed in consideration of the radiation performance of the antenna module 400. For example, the first surface 811 may not be disposed inside the recess 5202.

The display 301 may include a first display area A1 in which the second layer 520 is disposed, and a second display area A2 in which the second layer 520 is not disposed. Due to the first opening 5201, the first display area A1 and the second display area A2 have different medium layer structures; thus, luminance deterioration by external light such as sun light in the first display area A1 and the second display area A2 may be different. For example, in the second display area A2, external light such as sunlight is reflected from the antenna module 400 and the air gap G, which is a lower medium under the first layer 510 to be absorbed into a semiconductor element, thereby having luminance lower than that of the first display area A1 under the same condition. Due to luminance difference between the first display area A1 and the second display area A2, it is difficult to have substantially uniform brightness over the entire screen, which may degrade an image quality. In the first display area A1, there may be a first amount of light reflected from the second layer 520 and flowing into the first layer 510. In the second display area A2, there may be a second amount of light reflected from the air gap G and the antenna module 400 and flowing into the first layer 510. According to an embodiment, media of various materials may be disposed between the first layer 510 of the display 301 and the first surface 811 of the antenna module 400 so that the first light amount and the second light amount are substantially the same. Accordingly, the luminance change of the first display area A1 and the luminance change of the second display area A2 are generally constant because of an electrical influence of the reflected light, and an image quality may be improved. When a medium is added between the first layer 510 of the display 301 and the first surface 811 of the antenna module 400, the air gap G may be reduced between the first layer 510 of the display 301 and the first surfaces 811 of the antenna module 400, or in some embodiments, the air gap G may be absent. The reflectivity of the interface between the two media may be determined based on a refractive index of the two media, and a medium disposed between the first layer 510 of the display 301 and the first surface 811 of the antenna module 400 may be determined in consideration of this. According to various embodiments, a medium disposed between the first layer 510 of the display 301 and the first surface 811 of the antenna module 400 may include an anti-reflection layer capable of suppressing light reflection.

Figure 10:
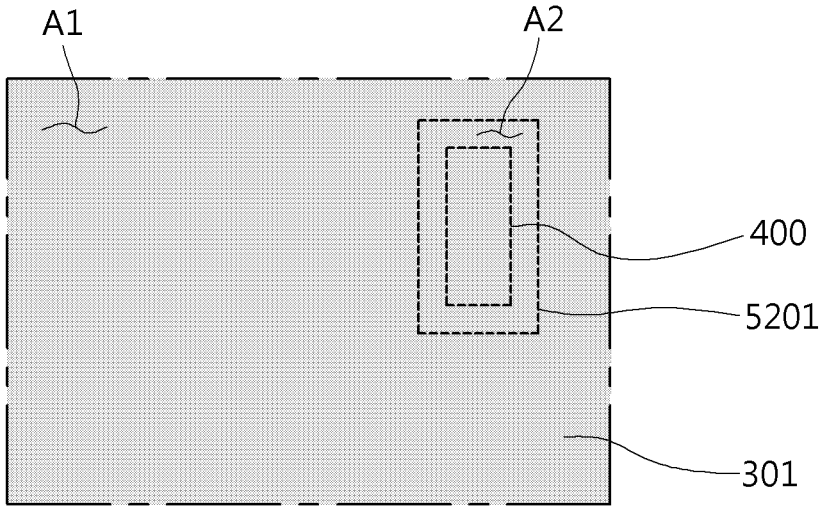
FIG. 10 is a diagram illustrating an example image when the electronic device of FIG. 5 outputs monochromatic light in a visible light band through a display according to an embodiment.

FIG. 10 is a diagram illustrating an example image when the electronic device 300 of FIG. 5 outputs monochromatic light in a visible light band through a display 301 according to an embodiment.

Referring to FIGS. 5 and 10, the display 301 may include a first display area A1 in which the second layer 520 is disposed, and a second display area A2 in which the second layer 520 is not disposed because of the first opening 5201. According to an embodiment, luminance decrease of the second display area A2 by energy radiated from the antenna module 400 may be substantially absent or insignificant; thus, it may be difficult to recognize the luminance difference between the first display area A1 and the second display area A2. According to various embodiments, even if the antenna module 400 radiates energy toward the display 301, the luminance difference between the first display area A1 and the second display area A2 may be a threshold value or less; thus, an image quality may be secured.

Referring to FIG. 5, in an example embodiment, when viewed from above the front plate 302, the first support member 411 may include a second opening 4112 at least partially overlapping the recess 5202 of the display 301. The antenna module 400 may be disposed near the display 301 through the second opening 4112, which may contribute to slimming of the electronic device 300.

According to an example embodiment, the second support member 490 may include a first portion 491 coupled with the first support member 411 and a second portion 492 extended from the first portion 491 and in which the antenna module 400 is disposed. The first portion 491 may be coupled to one surface of the first support member 411 facing the rear plate 311 through the bolt B. The antenna module 400 may be attached to the second portion 492 through a bonding material 580 between the first layer 510 of the display 301 and the second portion 492 of the second support member 490. The bonding material 580 may be disposed between the first wireless communication circuit 830 in the form of a chip and the second portion 492. The second portion 492 may be formed in a flat shape substantially parallel to the antenna structure 800. When the second support member 490 in which the antenna module 400 is disposed is coupled to the first support member 411, the antenna module 400 may be disposed to face at a preset separation distance (e.g., the height H of FIG. 5 in consideration of a tolerance so as to secure a radiation performance) from the first layer 510 of the display 301 through the second opening 4112 of the first support member 411 and the recess 5202 of the display 301. According to an example embodiment, the second support member 490 may be formed with a plate made of various metals such as SUS to be substantially rigid. The second support member 490 may be implemented with various other materials.

According to an example embodiment, the second portion 492 of the second support member 490 may be disposed closer to the first layer 510 of the display 301, compared with the first portion 491. The second support member 490 may include a third portion 493 between the first portion 491 and the second portion 492, and the third portion 493 may be formed in an inclined shape to the first portion 491 or the second portion 492.

According to various embodiments (not illustrated), in order to dispose the antenna module 400 at a preset separation distance (e.g., a height H in consideration of a tolerance so as to secure a radiation performance) from the first layer 510 of the display 301, the third portion 493 of the second support member 490 may be implemented flat. According to some embodiments (not illustrated), the third portion 493 of the second support member 490 may be implemented to be inclined toward the rear plate 311.

According to various embodiments (not illustrated), the second support member 490 may be implemented to include a plurality of portions extended from the second portion 492 to be coupled to the first support member 411, as in the first portion 491. For example, the second support member 490 may include a portion disposed at the side opposite to that of the first portion 491 to be coupled with the first support member 411. Thereby, the second support member 490 may be disposed on the first support member 411 without shaking or sagging against external impacts or loads; thus, a separation distance (e.g., the height H of the air gap G) between the first surface 811 of the antenna module 400 and the first layer 510 of the display 301 may be maintained.

According to various embodiments, the second support member 490 may be made of a heat transfer material. The second support member 490 may serve as a heat spreader that diffuses or disperses a heat radiated from the antenna module 400. According to various embodiments, the bonding material 580 between the antenna module 400 and the second support member 490 may include a heat transfer material. The bonding material may transfer a heat radiated from the antenna module 400 to the second support member 490.

According to various embodiments, the second support member 490 may be connected to a heat spreader or a heat pipe disposed between the first support member 411 and the rear plate 311 or at various other locations. A heat dissipated from the antenna module 400 may be moved to various heat dissipating structures such as a heat spreader or a heat pipe through the second support member 490.

According to various embodiments (not illustrated), the electronic device 300 may further include a thermally conductive member connected to the second support member 490. The thermally conductive member may be attached to a surface 490*b* disposed at the side opposite to that of a surface in which the antenna module 400 is disposed. The thermally conductive member may be a portion of a heat spreader or a heat pipe, and a heat radiated from the antenna module 400 may move to the thermally conductive member through the second support member 490.

According to an example embodiment, the first substrate assembly 441 or the second printed circuit board 540 of the first substrate assembly 441 may be coupled to the first support member 411 together with the second support member 490 through the bolt B. The first portion 491 of the second support member 490 may be disposed between the first substrate assembly 441 and the rear plate 311.

According to some embodiments (not illustrated), the first portion 491 of the second support member 490 may be disposed between the second printed circuit board 540 and the first support member 411, and be coupled to the first support member 411 through various methods such as a bolt.

According to some embodiments (not illustrated), the first portion 491 of the second support member 490 may be fixed to one surface 542 of the second printed circuit board 540 facing the third support member 461 through a bonding material such as a solder.

According to some embodiments (not illustrated), the antenna module 400 may be disposed at the first support member 411 between the first support member 411 and the display 301. In this case, the second support member 490 and the second opening 4911 may be omitted.

According to an example embodiment, the third support member 461 may be disposed between the first support member 411 and the rear plate 311 and be coupled to the first support member 411 through a fastening element such as a bolt. The third support member 461 may cover and protect the first substrate assembly 441, the antenna module 400, and the second support member 490.

According to an embodiment, the antenna module 400 may be electrically connected to the first substrate assembly 441. For example, the antenna module 400 may be electrically connected to the second printed circuit board 540 of the first substrate assembly 441 through various electrical paths such as a flexible printed circuit board (FPCB).

Figure 11:
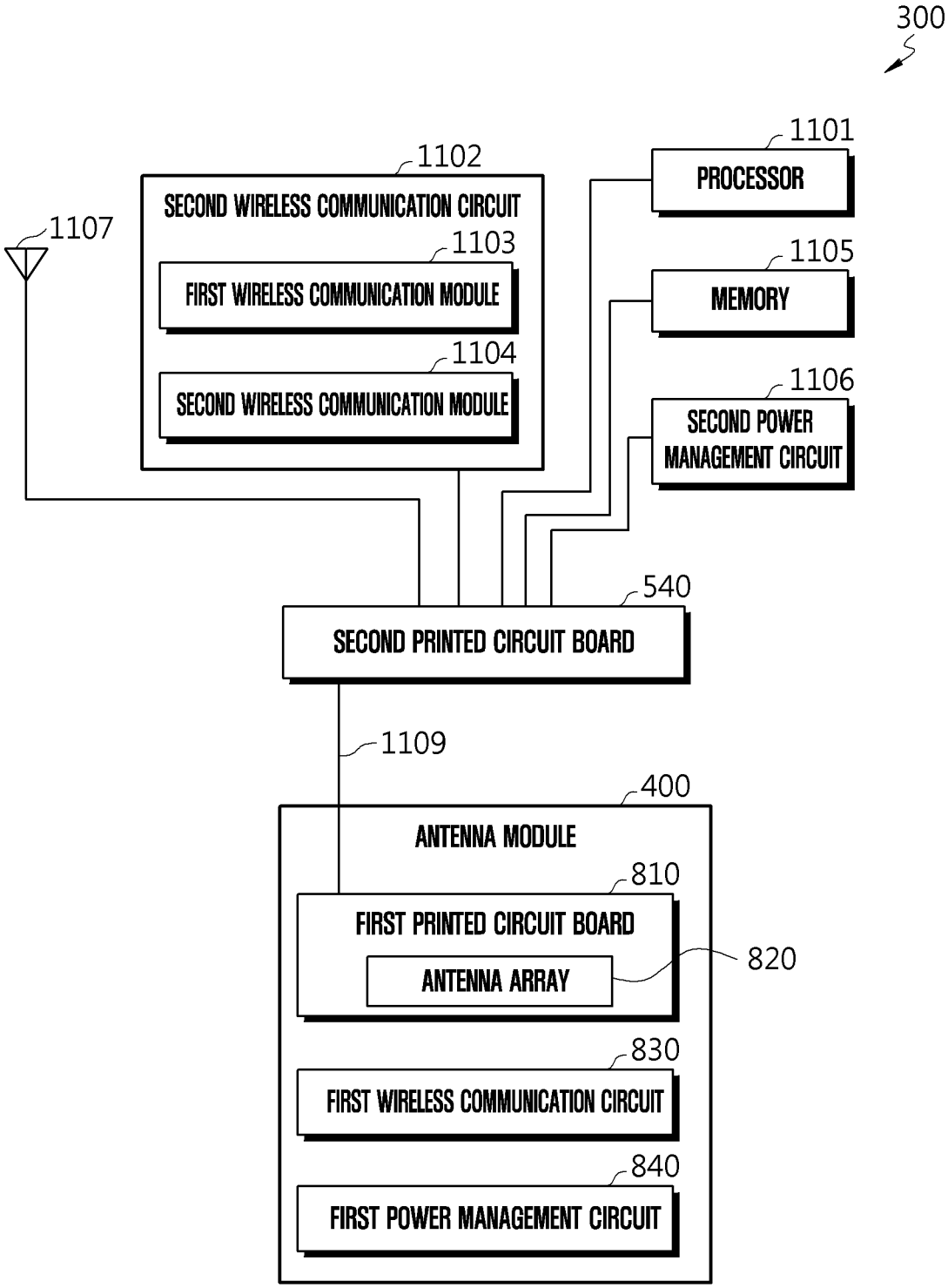
FIG. 11 is a block diagram illustrating the electronic device of FIG. 5 according to an embodiment.

FIG. 11 is a block diagram illustrating the electronic device 300 of FIG. 5 according to an embodiment.

Referring to FIG. 11, the electronic device 300 may include an antenna module (e.g., including an antenna array) 400, a second printed circuit board 540, a processor (e.g., including processing circuitry) 1101, a second wireless communication circuit 1102, a memory 1105, a second power management module (e.g., including power management circuitry) 1106, and/or at least one antenna 1107.

According to an embodiment, the antenna module 400 may include a first printed circuit board 810, first wireless communication circuit 830, and/or first power management circuit 840. The first printed circuit board 810 may include an antenna array 820 including a plurality of antenna elements 821, 822, 823, and 824 (see FIG. 8).

According to an embodiment, the processor 1101 (e.g., the processor 120 of FIG. 1 or 2), the second wireless communication circuit 1102 (e.g., the wireless communication module 192 of FIG. 1 or 2), the memory 1105 (e.g., the memory 130 of FIG. 1 or 2), the second power management circuit 1106 (e.g., the power management module 188 of FIG. 1), or at least one antenna 1107 (e.g., the antenna module 197 of FIG. 1, or the first antenna module 242 or the second antenna module 244 of FIG. 2) may be electrically connected to the second printed circuit board 540. The processor 1101, the second wireless communication circuit 1102, the memory 1105, or the second power management circuit 1106 may be disposed at the second printed circuit board 540 through a conductive bonding member such as a solder. The at least one antenna 1107 (e.g., the first antenna module 242 or the second antenna module 244 of FIG. 2) may be separated from the second printed circuit board 540, and be electrically connected to the second printed circuit board 540 through various electrical paths. According to some embodiments, the at least one antenna 1107 may be disposed at the second printed circuit board 540 or may be implemented into a conductive pattern (e.g., microstrip) included in the second printed circuit board 540. According to various embodiments, the at least one antenna 1107 may be implemented into at least a portion of a housing (e.g., the side bezel structure 318 of FIG. 3A) that forms an external shape of the electronic device 300.

According to an example embodiment, the first printed circuit board 810 and the second printed circuit board 540 may be electrically connected through various electrical paths 1109 such as a flexible printed circuit board (FPCB). For example, a first connector (not illustrated) may be disposed at the first printed circuit board 810 through a conductive bonding member such as a solder, and be electrically connected to the first printed circuit board 810. A second connector (not illustrated) may be disposed at the second printed circuit board 540 through a conductive bonding member such as a solder, and be electrically connected to the second printed circuit board 540. The electrical path 1109 may electrically connect the first connector and the second connector.

Referring to FIG. 5, the second printed circuit board 540 may include, for example, one surface 541 and the other surface 542 facing in opposite directions. According to an example embodiment, the first surface 811 or the second surface 812 of the antenna module 400 may be substantially parallel to one surface 541 or the other side 542 of the second printed circuit board 540.

Referring to FIGS. 5 and 11, in an example embodiment, the first wireless communication circuit 830 of the antenna module 400 may transmit and/or receive a first signal in at least some frequency bands of about 6 GHz to about 100 GHz through the antenna array 820. According to various embodiments, the first wireless communication circuit 830 may include the third RFIC 226 of FIG. 2. The first wireless communication circuit 830 may up-convert or down-convert a frequency of a transmitted or received signal. According to an embodiment, the first wireless communication circuit 830 may receive an IF signal from the second wireless communication module 1104 of the second wireless communication circuit 1102 and up-convert the received IF signal to an RF signal. According to an embodiment, the first wireless communication circuit 830 may down-convert the RF signal (e.g., millimeter wave) received through the antenna array 820 (e.g., the antenna 248 of FIG. 2) into an IF signal and the IF signal may be provided to the second wireless communication module 1104 of the second wireless communication circuit 1102.

According to various embodiments, the first wireless communication circuit 830 may include at least one phase shifter (e.g., the phase shifter 238 of FIG. 2) electrically connected to a plurality of antenna elements 821, 822, 823, and 824 (see FIG. 8) included in the antenna array 820. Upon transmission, the at least one phase shifter may convert a phase of a 5G Above6 RF signal to be transmitted to the outside (e.g., a base station of a 5G network) of the electronic device 300 through the plurality of antenna elements 821, 822, 823, and 824. Upon reception, at least one phase shifter may convert a phase of the 5G Above6 RF signal received from the outside through the plurality of antenna elements 821, 822, 823, and 824. The at least one phase shifter may enable transmission or reception through beamforming between the electronic device 300 and the outside.

According to an embodiment, at least some of a plurality of conductive layers included in the first printed circuit board 810 may include a transmission line (e.g., RF line) between the antenna array 820 and the first wireless communication circuit 830. The transmission line is a structure for transferring a frequency signal (e.g., voltage or current) and may be a conductive system using a transfer function of waves by electrical parameters (e.g., resistance, inductance, conductance, or capacitance per unit length). For example, some of the plurality of conductive layers included in the first printed circuit board 810 may include an electrical path for supplying power to the antenna array 820 between the antenna array 820 and the first wireless communication circuit 830.

The processor 1101 may include various processing circuitry and execute, for example, software to control at least one component (e.g., hardware or software component) of the electronic device 300 electrically connected to the processor 1101, and perform various data processing or operations. According to an embodiment, the processor 1101 may transmit and/or receive a signal through the second wireless communication circuit 1102. The processor 1101 may write data at the memory 1105 and read data from the memory 1105. The processor 1101 may perform functions of a protocol stack required for a communication specification. At least a portion of the second wireless communication circuit 1102 and/or the processor 1101 may be referred to a communication processor (CP) (e.g., the first communication processor 212 and/or the second communication processor 214 of FIG. 2).

According to an embodiment, the second wireless communication circuit 1102 (e.g., the wireless communication module 192 of FIG. 2) may perform functions for transmitting or receiving a signal through a wireless channel. The second wireless communication circuit 1102 may perform a change function between a baseband signal and/or a bit string according to a physical layer specification of the system. For example, upon data transmission, the second wireless communication circuit 1102 may encode and modulate a transmission bit string to generate complex symbols. For example, when receiving data, the second wireless communication circuit 1102 may demodulate and decode the baseband signal to restore the received bit string. The second wireless communication circuit 1102 may up-convert the RF signal and transmit the RF signal through at least one antenna, and down-convert the RF signal received through the at least one antenna into a baseband signal. According to an example embodiment, the second wireless communication circuit 1102 may include elements such as a transmission filter, amplifier, mixer, oscillator, digital to analog converter (DAC), or analog to digital converter (ADC).

According to an embodiment, the second wireless communication circuit 1102 may include a plurality of wireless communication modules for processing signals of different frequency bands. For example, the second wireless communication circuit 1102 may include a plurality of wireless communication modules so as to support a plurality of different wireless access technologies. For example, different wireless access technologies may include Bluetooth low energy (BLE), wireless fidelity (WiFi), WiFi Gigabyte (WiGig), or a cellular network (e.g., long term evolution (LTE)). Further, different frequency bands may include a super high frequency (SHF) (e.g., about 2.5 GHz or about 5 GHz) band and a millimeter wave (e.g., about 60 GHz) band.

According to an embodiment, the second wireless communication circuit 1102 may include a baseband processor, at least one communication circuit (e.g., intermediate frequency integrated circuit (IFIC)), or a radio frequency integrated circuit (RFIC). The second wireless communication circuit 1102 may include, for example, a baseband processor separate from the processor 1101 (e.g., application processor (AP)).

According to an embodiment, the second wireless communication circuit 1102 may include at least one of the first wireless communication module 1103 or the second wireless communication module 1104. The electronic device 300 may further include one or more interfaces for supporting inter-chip communication between the second wireless communication circuit 1102 and the processor 1101. The processor 1101 and the first wireless communication module 1103 or the second wireless communication module 1104 may transmit or receive data (or signals) using the inter-chip interface (e.g., inter processor communication channel).

According to an embodiment, the first wireless communication module 1103 or the second wireless communication module 1104 may provide an interface for communicating with other entities. The first wireless communication module 1103 may support wireless communication related to a first network (e.g., the first cellular network 292 of FIG. 2) using, for example, at least one antenna 1107. The first wireless communication module 1103 may include, for example, the first RFIC 222 and/or the first RFFE 232 of FIG. 2. The second wireless communication module 1104 may support wireless communication related to a second network (e.g., the second cellular network 294 of FIG. 2) using, for example, the antenna module 400.

The second wireless communication module 1104 may include, for example, the fourth RFIC 228 of FIG. 2. According to an example embodiment, the first network may include a 4th generation (4G) network, and the second network may include a 5th generation (5G) network. According to various embodiments, the first network may be related to wireless fidelity (WiFi) or a global positioning system (GPS).

According to an embodiment, the first wireless communication module 1103 may receive a high frequency signal (hereinafter, RF signal) related to a first network (e.g., 4G network) through at least one antenna 1107 and modulate (e.g., down-convert) the received RF signal into a low frequency signal (hereinafter, baseband signal) and transmit the low frequency signal to the processor 1101. The first wireless communication module 1103 may receive a baseband signal of the first network from the processor 1101 and modulate (e.g., up-convert) the received baseband signal into an RF signal to transmit the RF signal to the outside through at least one antenna 1107. According to an embodiment, the first wireless communication module 1103 may include an RFIC. According to various embodiments, when modulating an RF signal into a baseband signal or modulating a baseband signal into an RF signal, an input of a local oscillator (LO) may be used.

According to an embodiment, the second wireless communication module 1104 may receive a baseband signal of the second network from the processor 1101. The second wireless communication module 1104 may up-convert a baseband signal to an IF signal using an input (hereinafter, LO signal) of a local oscillator (LO) and transmit the IF signal to the antenna module 400. The antenna module 400 may receive an IF signal from the second wireless communication module 1104. The antenna module 400 may up-convert the IF signal to an RF signal using the LO signal, and transmit the RF signal to the outside through the antenna array 820 of the antenna module 400. According to an embodiment, the antenna module 400 may receive an RF signal through the antenna array 820. The antenna module 400 may down-convert the RF signal into an IF signal using the LO signal, and transmit the IF signal to the second wireless communication module 1104. The second wireless communication module 1104 may receive the IF signal from the antenna module 400. The second wireless communication module 1104 may down-convert the IF signal into a baseband signal using the LO signal and transmit the baseband signal to the second wireless communication circuit 1102. According to an embodiment, the second wireless communication module 1104 may include an IFIC. The second wireless communication module 1104 may transmit and/or receive a second signal in a frequency band between about 5 GHz and about 15 GHz.

According to an embodiment, the first wireless communication circuit 830 of the antenna module 400 may include a plurality of transmission/reception paths. For example, the first wireless communication circuit 830 may include a beamforming system for processing a transmission or reception signal such that energy radiated from the plurality of antenna elements 821, 822, 823, and 824 of the antenna array 820 (see FIG. 8) is concentrated in a specific direction in a space. The beamforming system may be configured to receive a signal having a stronger intensity in a desired direction or to transmit a signal in a desired direction, or to prevent and/or reduce a signal coming from an unwanted direction from receiving. The beamforming system may adjust a form and direction of the beam using a difference in amplitude or phase of a carrier signal in the RF band. According to an embodiment, the second wireless communication module 1104 or the first wireless communication circuit 830 may control each antenna element to have a phase difference. For example, the second wireless communication module 1104 or the first wireless communication circuit 830 may include a first electrical path electrically connected to a first point on the first antenna element and a second electrical path electrically connected to a second point on the second antenna element. The processor 1101, the second wireless communication module 1104, or the first wireless communication circuit 830 may provide a phase difference between a first signal at the first point and a second signal at the second point. According to various embodiments (not illustrated), the electronic device 300 may include one or more phase shifters disposed at the antenna module 400 (or the first wireless communication circuit 830) or the first printed circuit board 810. The one or more phase shifters may adjust a phase of a plurality of antenna elements 821, 822, 823, and 824 (see FIG. 8) of the antenna array 820.

For example, the beamforming system may adjust a phase of a current supplied to the plurality of antenna elements 821, 822, 823, and 824 (see FIG. 8) of the antenna array 820 to form a beam pattern (e.g., beam width, beam direction). According to an embodiment, by the beamforming system, a plurality of antenna elements 821, 822, 823, and 824 (see FIG. 8) of the antenna array 820 may form a beam in which energy is relatively much radiated in a direction (e.g., +z axis direction) in which a first surface 811 (see FIG. 5) of the first printed circuit board 810 faces.

According to an embodiment, the memory 1105 may store codebook information regarding beamforming. The processor 1101, the second wireless communication module 1104, or the first wireless communication circuit 830 may efficiently control (e.g., allocate or dispose) multiple beams through the plurality of antenna elements 821, 822, 823, and 824 (see FIG. 8) of the antenna array 820 based on codebook information.

According to various embodiments, the first wireless communication module 1103 and/or the second wireless communication module 1104 may form one module with the processor 1101. For example, the first wireless communication module 1103 and/or the second wireless communication module 1104 may be integrally formed with the processor 1101. According to some embodiments, the first wireless communication module 1103 and/or the second wireless communication module 1104 may be disposed in one chip or may be formed in a separate chip form.

According to an embodiment, the processor 1101 and one wireless communication module (e.g., the first wireless communication module 1103) may be integrally formed in one chip (SoC chip), and the other wireless communication module (e.g., the second wireless communication module 1104) may be formed in an independent chip form.

According to an embodiment, the second power management circuit 1106 may manage power supplied to the electronic device 300 using power of a battery (e.g., the battery 189 of FIG. 1) electrically connected to the second printed circuit board 540. The first power management circuit 840 of the antenna module 400 may receive power from the second power management circuit 1106 through an electrical path such as a flexible printed circuit board and manage power supplied to the antenna module 400 using the received power. According to an embodiment, the first power management circuit 840 may be implemented into, for example, at least a portion of the PMIC. According to some embodiments, the first power management circuit 840 may be omitted in the antenna module 400, and for example, the second power management circuit 1106 may manage power supplied to the antenna module 400.

According to various embodiments (not illustrated), the electronic device 300 may further include an antenna module (e.g., the third antenna module 246 of FIG. 2) having substantially the same structure as that of the antenna module 400. The printed circuit board (e.g., the first printed circuit board 810 of FIG. 8) of the antenna module may be disposed substantially parallel to the second printed circuit board 540. The printed circuit board of the antenna module may include an antenna array (e.g., the antenna array 820 of FIG. 8) disposed at one surface facing the rear plate 311 (see FIG. 3B) or inside the printed circuit board close to the one surface. The printed circuit board of the antenna module may be disposed between the second printed circuit board 540 and the rear plate 311. The processor 1101, the second wireless communication module 1104, or the wireless communication circuit (e.g., the first wireless communication circuit 830 of FIG. 9) included in the antenna module may control the antenna module to form a beam in which energy is relatively much radiated toward the rear plate 311 (e.g., in a −z axis direction) based on codebook information stored in the memory 1105. The antenna module may transmit and/or receive radio waves by radiating energy toward the rear surface 310B (see FIG. 5), thereby securing coverage toward the rear surface 310B.

In various embodiments, referring to FIG. 7A, the electronic device 300 may further include an antenna module 700*a* (e.g., the third antenna module 246 of FIG. 2) having substantially the same structure as that of the antenna module 400. Referring to FIGS. 5 and 7A, the printed circuit board 710*a* (e.g., the first printed circuit board 810 of FIG. 8) of the antenna module 700*a* may be disposed to be not parallel to the second printed circuit board 540. According to an example embodiment, the printed circuit board 710*a* of the antenna module 700*a* may be perpendicular to the second printed circuit board 540 and be disposed near the side member 318. According to various embodiments, the printed circuit board 710*a* of the antenna module 700*a* may form an acute angle or an obtuse angle with the second printed circuit board 540. The printed circuit board 710*a* of the antenna module 700*a* may include an antenna array 720*a* (e.g., the antenna array 820 of FIG. 8) disposed on the first surface 711*a* facing the side surface 310C, or inside the printed circuit board 710*a* closer to the first surface 711*a* than the second surface 712*a*. The wireless communication circuit (e.g., the first wireless communication circuit 830 of FIG. 9) included in the processor 1101, the second wireless communication module 1104, or the antenna module 700*a* may control the antenna module 700*a* to form a beam in which energy is relatively much radiated toward the side surface 310C (e.g., in a +y axis direction) based on codebook information stored in the memory 1105. The antenna module 700*a* may radiate energy toward the side surface 310C to transmit and/or receive radio waves, thereby securing coverage toward the side surface 310C. FIG. 7A illustrates one antenna module 700*a* disposed near the first side portion 701, but it is not limited thereto, and various numbers of antenna modules may be disposed near the first side portion 701, the second side portion 702, the third side portion 703, and the fourth side portion 704 at various positions.

Referring to FIG. 7A, in an example embodiment, the side member 318 may include a conductive portion 318*a* and a non-conductive portion 318*b* coupled with the conductive portion 318*a*. The non-conductive portion 318*b* may be disposed to face the first surface 711*a* of the antenna module 700*a*, and substantially overlap the antenna array 720*a*, when viewed toward the first surface 711*a*. Referring to FIGS. 5 and 7A, in an example embodiment, the conductive portion 318*a* may include a notch (not illustrated) in a dug shape in a direction advancing from the rear plate 311 to the front plate 302, and the non-conductive portion 318*b* may be disposed at least partially in the notch. The notch and the non-conductive portion 318*b* disposed thereon enable the conductive portion 318*a* of the side member 318 to reduce the effect of radio waves radiated from the antenna array 720*a*, thereby reducing deformation (or distortion) of the beam pattern or enabling to secure coverage (communication range). According to various embodiments, the rear plate 311 may be extended toward the side surface 310*b* so as to cover the non-conductive portion 318*b* (see an imaginary line indicated by reference numeral 311*b* in FIG. 5).

Figure 12:
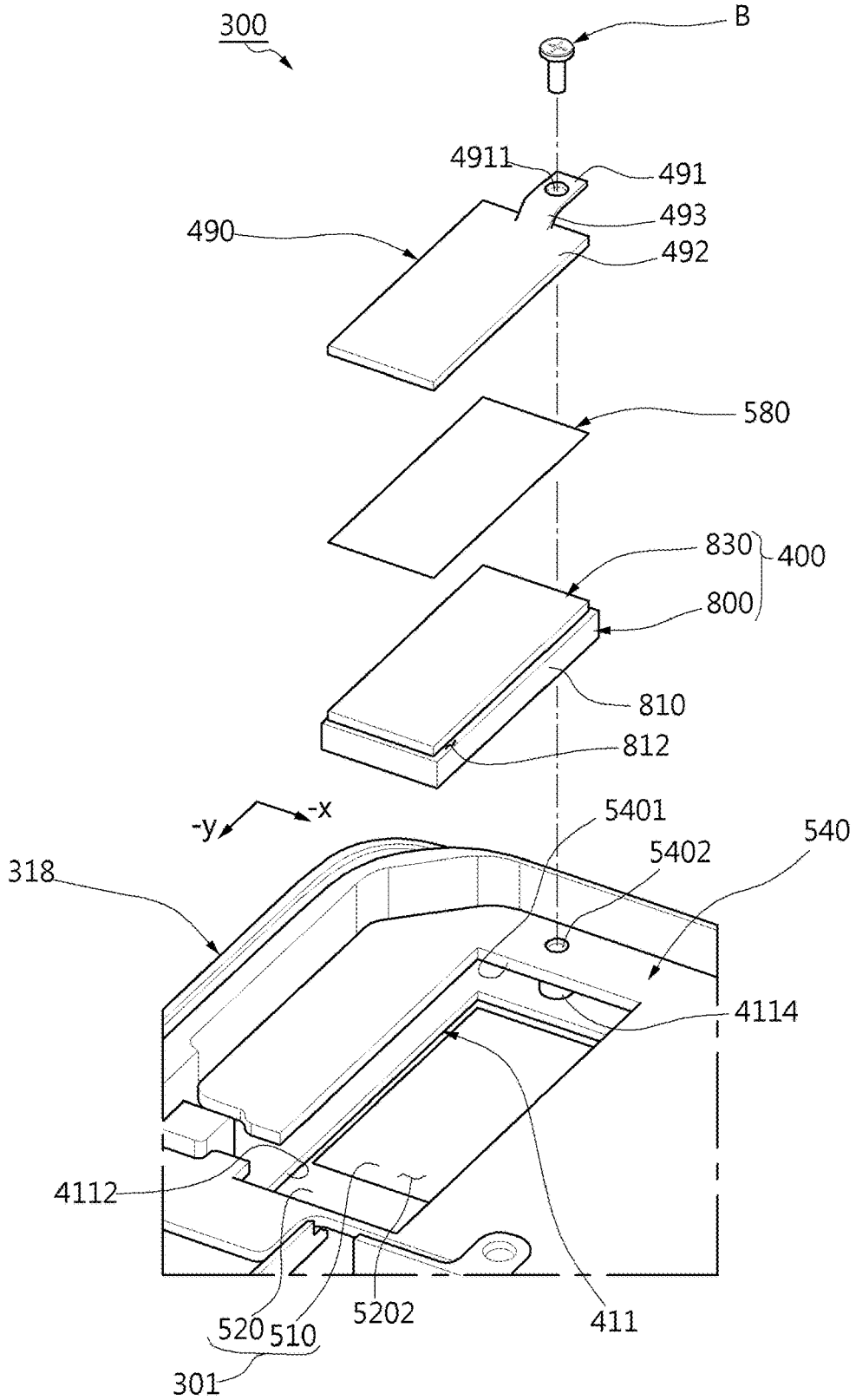
FIG. 12 is an exploded perspective view illustrating an electronic device related to an antenna module according to an embodiment.

FIG. 12 is an exploded perspective view illustrating an electronic device 300 related to an antenna module 400 according to an embodiment.

Referring to FIG. 12, in an example embodiment, the electronic device 300 may include a side member (or side bezel structure) 318, first support member 411, display 301, antenna module 400, bonding material 580, second support member 490, and/or second printed circuit board 540.

According to an embodiment, the first support member 411 may be connected to the side bezel structure 318 or may be integrally formed with the side bezel structure 318. The first support member 411 may be made of, for example, a metal material and/or a non-metal material. At least a portion of the first support member 411 may be disposed between the second printed circuit board 540 and the display 301. According to an embodiment, the first support member 411 may include a second opening 4112 for disposing the antenna module 400.

According to an embodiment, the display 301 may include a recess 5202 formed by the first opening 5201 (see FIG. 5) of the second layer 520. The recess 5202 may overlap at least partially the second opening 4112 of the first support member 411. The first layer 510 of the display 301 may be exposed toward the antenna module 400 through the recess 5202.

According to an embodiment, the second printed circuit board 540 may include a third opening 5401 at least partially overlapping the second opening 4112 of the first support member 411.

According to an embodiment, the antenna module 400 may include an antenna structure 800 implemented into the first printed circuit board 810 including the antenna array 820 of FIG. 8, and the first wireless communication circuit 830 disposed at the second surface 812 of the antenna structure 800. The antenna module 400 may be disposed near the first layer 510 of the display 301 through the third opening 5401 of the second printed circuit board 540, the second opening 4112 of the first support member 411, and the recess 5202 of the display 301. The antenna array 820 of FIG. 8 may be disposed on the first surface 811 (see FIG. 8) of the first printed circuit board 810, or inside the first printed circuit board 810 closer to the first surface 811 than the second surface 812 (see FIG. 9). The first surface 811 of the first printed circuit board 810 may face away from the first layer 510 of the display 301 through the recess 5202.

According to an example embodiment, the second support member 490 may include a first portion 491 coupled with the first support member 411 and a second portion 492 extended from the first portion 491 and in which the antenna module 400 is disposed. The first portion 491 may include a through hole 4911 for fastening a bolt. The second printed circuit board 540 may include a through hole 5402 for fastening a bolt. The bolt B may be fastened to a boss 4114 of the first support member 411 through the through hole 4911 of the second support member 490 and the through hole 5402 of the second printed circuit board 540. The first wireless communication circuit 830 (e.g., RFIC chip) of the antenna module 400 may be attached to the second portion 492 through the bonding material 580. The second portion 492 may be inserted into the third opening 5401 of the second printed circuit board 540 by an inclined third portion 493 between the first portion 491 and the second portion 492.

According to an example embodiment (not illustrated), the first printed circuit board 810 of the antenna module 400 may be electrically connected to the second printed circuit board 540 through an electrical path (e.g., the electrical path 1109 of FIG. 11) such as the flexible printed circuit board.

Figure 13:
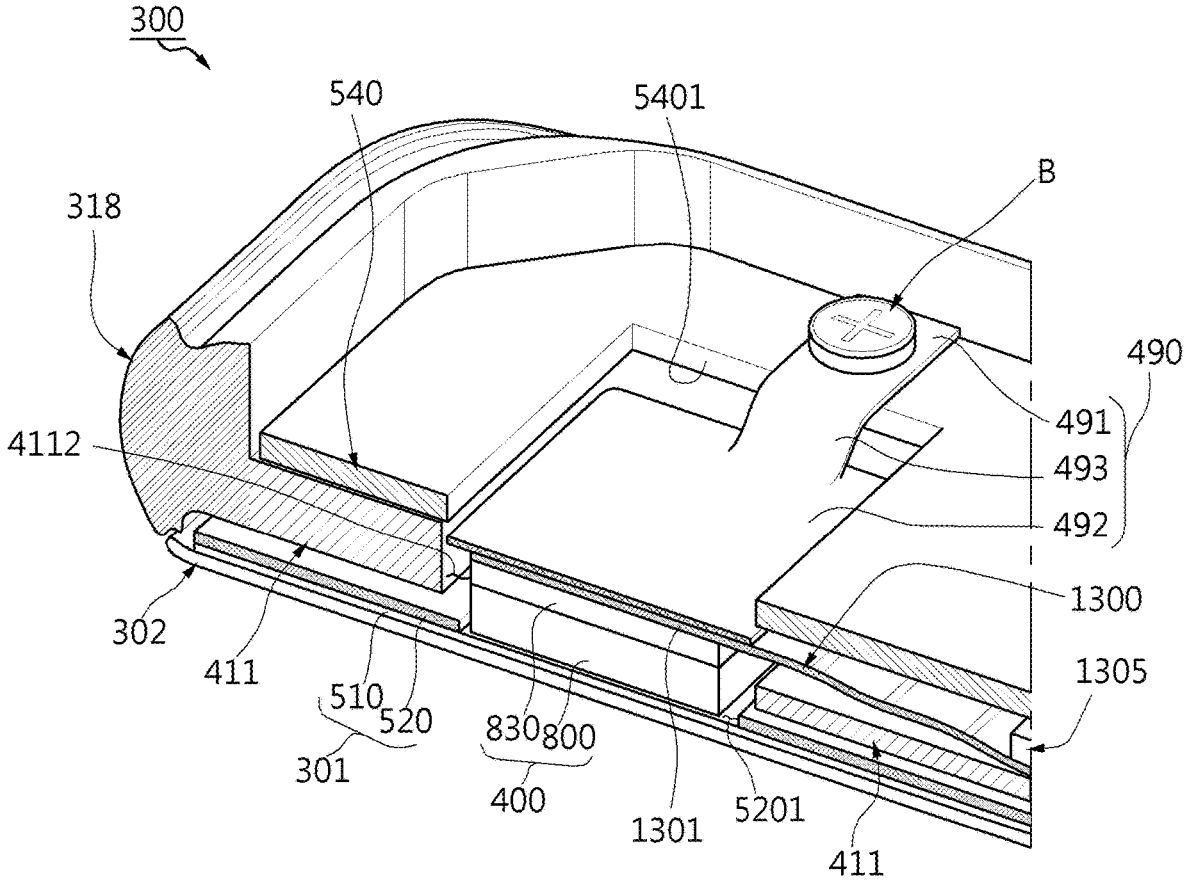
FIG. 13 is a partial cross-sectional view illustrating an electronic device related to an antenna module according to various embodiments.

FIG. 13 is a partial cross-sectional view illustrating an electronic device 300 related to an antenna module 400 according to various embodiments.

Referring to FIG. 13, in an example embodiment, the electronic device 300 may include a front plate 302, side member 318, first support member 411, display 301, antenna module 400, second support member 490, second printed circuit board 540, thermally conductive member 1300, or heat dissipation structure 1305. At least one of the components illustrated in FIG. 13 is substantially the same as at least one of the components illustrated in FIG. 5 or 12, and repeated descriptions may not be repeated below.

Referring to FIG. 13, in various embodiments, the heat dissipation structure 1305 may be disposed between the second printed circuit board 540 and the first support member 411 and may include, for example, a heat pipe or a heat spreader. Because of a component that consumes a large amount of current such as a processor (e.g., the processor 120 of FIG. 1 such as an application processor (AP)), a communication module (e.g., the communication module 190 of FIG. 1), or a charging module (e.g., the power management module 188 of FIG. 1) or current consumption in the component, a heat may occur in the battery (e.g., the battery 189 of FIG. 1). For example, when the processor has more work to deal with or when the communication module is driven to continuously catch signals, more heat may occur than that of a normal case. Such a heat may cause a decrease in system performance or affect the battery 189 in the worst case to increase the probability of explosion. The heat dissipation structure 1305 may distribute a heat generated inside the electronic device 300 so as not to be concentrated in one place. According to various embodiments, the heat dissipation structure 1305 may be implemented into a movement path of various heats based on a phenomenon in which a heat flows from a high temperature portion to a low temperature portion. For example, referring to FIG. 4, the heat dissipation structure 1305 may enable a heat radiated in the first substrate assembly 441 to flow to the second substrate assembly 442. The first substrate assembly 441 may include a metal cover (e.g., shield can) contacting the heat dissipation structure 1305 and covering at least a portion of the second printed circuit board 540 included in the first substrate assembly 441. The second substrate assembly 442 may include a metal cover (e.g., a shield can) contacting the heat dissipation structure 1305 and covering at least a portion of the third printed circuit board included in the second substrate assembly 442. The metal covers may serve to shield noise as well as heat radiation.

According to various embodiments, the heat dissipation structure 1305 may be in direct contact with at least a portion of the first support member 411, or a thermally conductive material may be disposed between the heat dissipation structure 1305 and the first support member 410; thus, the first support member 411 may serve as a heat spreader. According to various embodiments, a heat pipe as the heat dissipation structure 1305 may be implemented based on a metal housing or a polymer housing.

According to an embodiment, the heat dissipation structure 1305 may be disposed to not overlap the antenna module 400, when viewed from above the front plate 302. According to an example embodiment, the thermally conductive member 1300 may connect between the heat dissipation structure 1305 and the antenna module 400. A heat radiated from the antenna module 400 may flow to the heat dissipation structure 1305 through the heat conductive member 1300. According to an example embodiment, a portion 1301 of the thermally conductive member 1300 may be disposed between the antenna module 400 and the second portion 492 of the second support member 490. A thermal conductive bonding material (not illustrated) may be disposed between a portion 1301 of the thermally conductive member 1300 and a first portion 491 of the second support member 490 and between a portion 1301 of the thermally conductive member 1300 and the antenna module 400.

According to an example embodiment, the thermally conductive member 1300 may be a graphite sheet. According to various embodiments, the thermally conductive member 1300 may be implemented with various other materials.

According to various embodiments (not illustrated), the heat dissipation structure 1305 may be extended between the first portion 491 of the second support member 490 and the antenna module 400 in place of the thermally conductive member 1300. According to various embodiments, the heat dissipation structure 1305 may be referred to as a 'thermal conductive member'.

Figure 14:
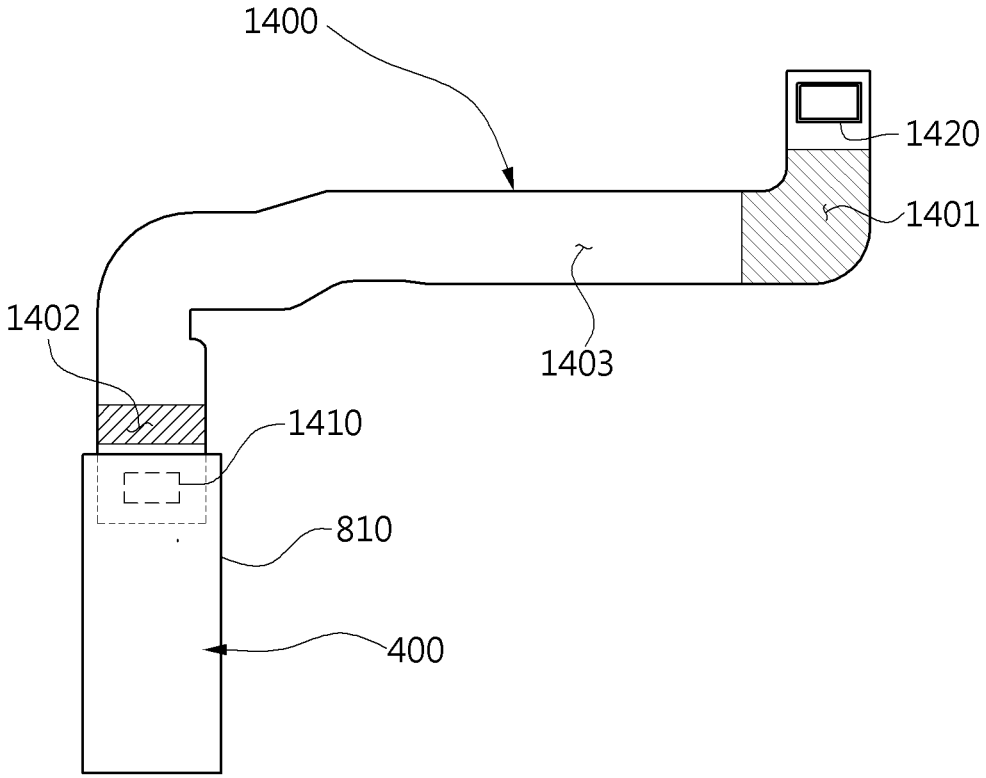
FIG. 14 is a diagram illustrating an example antenna module according to an embodiment.

FIG. 14 is a diagram illustrating an example antenna module 400 according to an embodiment.

Referring to FIG. 14, according to an embodiment, a flexible printed circuit board 1400 for electrical connection to the second printed circuit board 540 of FIG. 5 or 12 may be connected to the antenna module 400. The flexible printed circuit board 1400 may include a first connector 1410 disposed at one end and a second connector 1420 disposed at the other end. A partial area of the flexible printed circuit board 1400 in which the first connector 1410 is disposed may be disposed to overlap the first printed circuit board 810. The first connector 1410 may be electrically connected to a connector (not illustrated) disposed at the first printed circuit board 810 of the antenna module 400, and the second connector 1420 may be electrically connected to a connector (not illustrated) disposed at the second printed circuit board 540 of FIG. 5 or 12.

According to various embodiments, the first printed circuit board 810 and the flexible printed circuit board 1400 may be formed into a one-piece flexible printed circuit board, and in this case, the first connector 1410 may be omitted.

According to various embodiments, the first printed circuit board 810 and the flexible printed circuit board 1400 may be implemented into a one-piece rigid flexible printed circuit board. In this case, the first connector 1410 may be omitted. For example, the one-piece rigid flexible printed circuit board may include a first flexible area 1401 positioned near the second connector 1420. The one-piece rigid flexible printed circuit board may further include a second flexible area 1402 positioned near the antenna module 400. Areas (e.g., see reference numeral 1403) other than the flexible area (e.g., the first flexible area 1401 and the second flexible area 1402) may be rigidly formed. For another example, in the rigid flexible printed circuit board, a portion that replaces the first printed circuit board 810 may be rigid, and in the rigid flexible printed circuit board, a portion that replaces the flexible printed circuit board 1400 may be flexible.

According to various embodiments, the first printed circuit board 810 and the flexible printed circuit board 1400 may be electrically connected through anisotropic conductive film bonding (ACF bonding), and in this case, the first connector 1410 may be omitted. For example, the ACF may be an anisotropic conductive film that enables electricity to flow in only one side direction by forming in a film state by mixing fine conductive particles (e.g., Ni, carbon, solder ball) with an adhesive resin (e.g., thermosetting resin). When the ACF is disposed between the first printed circuit board 810 and the flexible printed circuit board 1400 and then is compressed by applying a heat and pressure, the conductive pattern formed in the first printed circuit board 810 may be electrically connected to the conductive pattern formed in the flexible printed circuit board 1400, and the adhesive resin may bond the first printed circuit board 810 and the flexible printed circuit board 1400.

According to various embodiments (not illustrated), the flexible printed circuit board 1400 may be replaced with various other electrical paths such as a coaxial cable. According to various embodiments (not illustrated), the antenna module 400 may be electrically connected to the second printed circuit board 540 of FIG. 5 or 12 through various electrical paths such as a board to board connector or an interposer.

Figure 15:
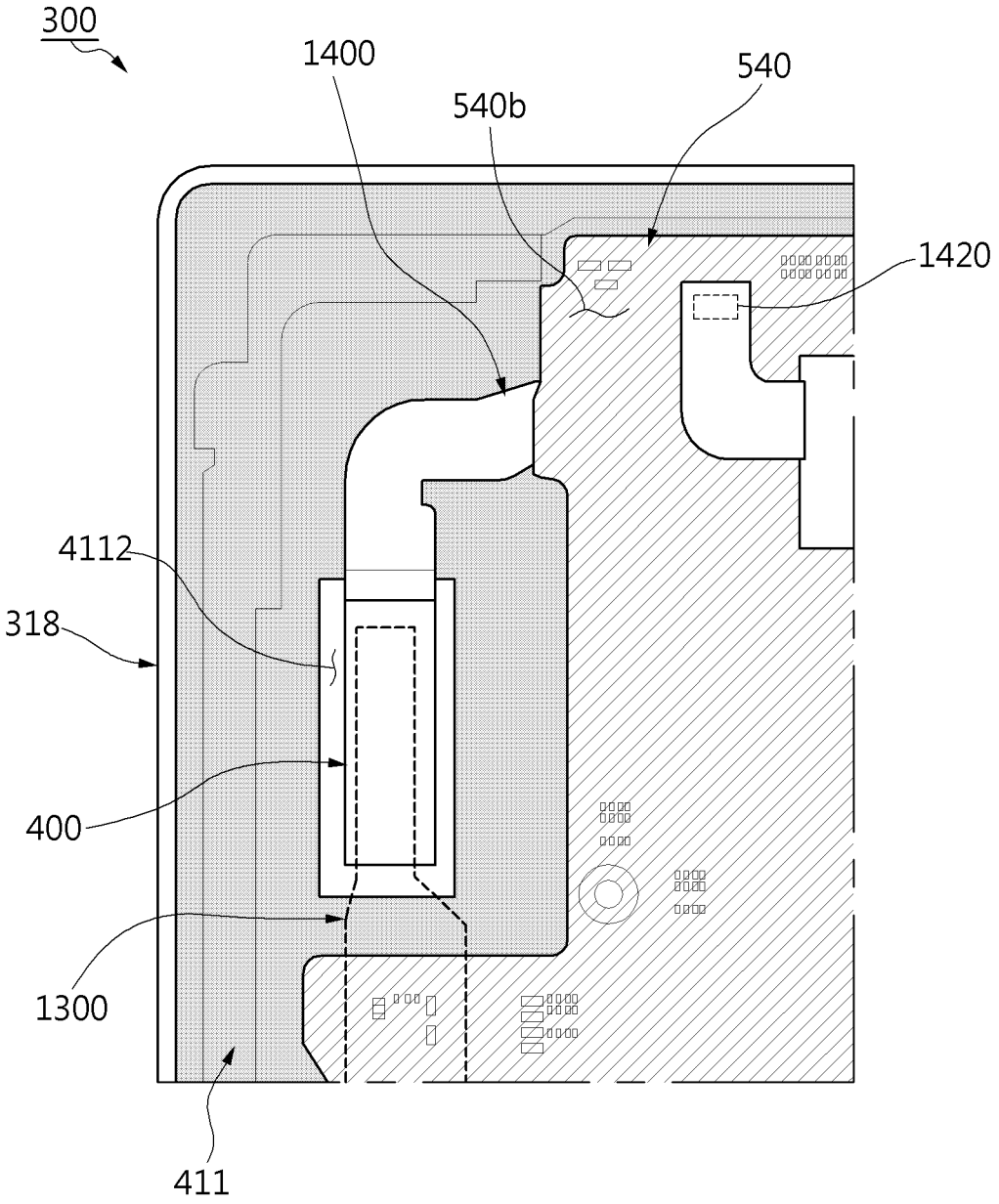
FIG. 15 is a diagram illustrating an example state in which the antenna module of FIG. 14 is disposed inside an electronic device according to an embodiment.

FIG. 15 illustrates an example state in which the antenna module 400 of FIG. 14 is disposed inside an electronic device 300 according to an embodiment.

Referring to FIG. 15, in an example embodiment, the electronic device 300 may include a side member (e.g., side bezel) 318, first support member 411, antenna module 400, second printed circuit board 540, and/or flexible printed circuit board 1400. The antenna module 400 may be disposed in the second opening 4112 formed in the first support member 411. The flexible printed circuit board 1400 may electrically connect the antenna module 400 and the second printed circuit board 540. The second printed circuit board 540 may include a third connector (not illustrated) disposed at one surface **540*b* facing the rear plate 311 of FIG. 5. According to an embodiment, while the flexible printed circuit board 1400 is extended between the second printed circuit board 540 and the first support member 411, a portion including the second connector 1420 may be bent toward the one surface 540*b* and thus the second connector 1420** may be connected to the third connector.

According to an embodiment, the electronic device 300 may include a thermally conductive member 1300 (seen FIG. 13), which is a heat transfer path for enabling a heat radiated from the antenna module 400 to flow to a heat dissipation structure (e.g., the heat dissipation structure 1305 of FIG. 13).

Figure 16:
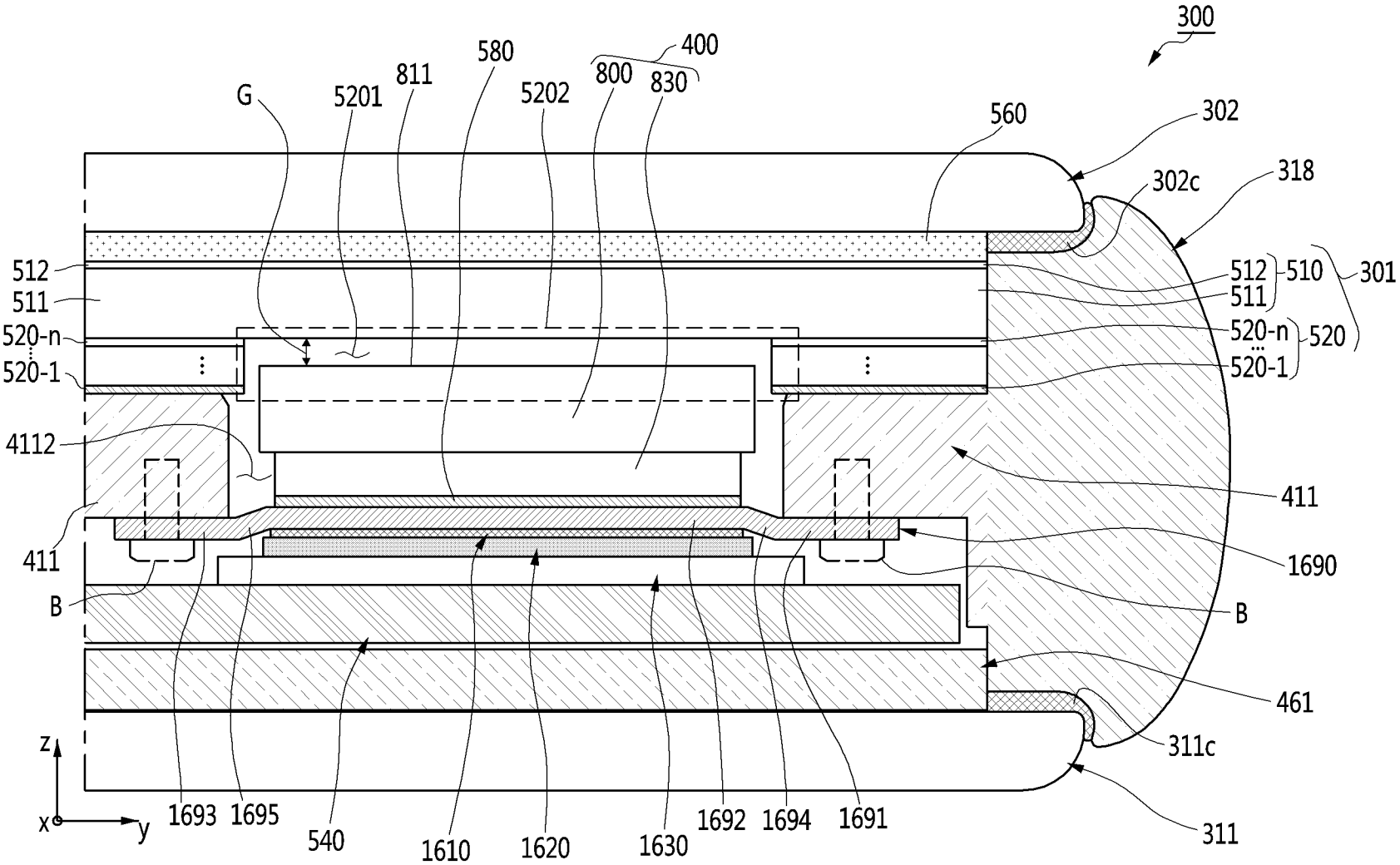
FIG. 16 is a cross-sectional view taken along line A-A' in the electronic device of FIG. 3A according to an embodiment.
Figure 17:
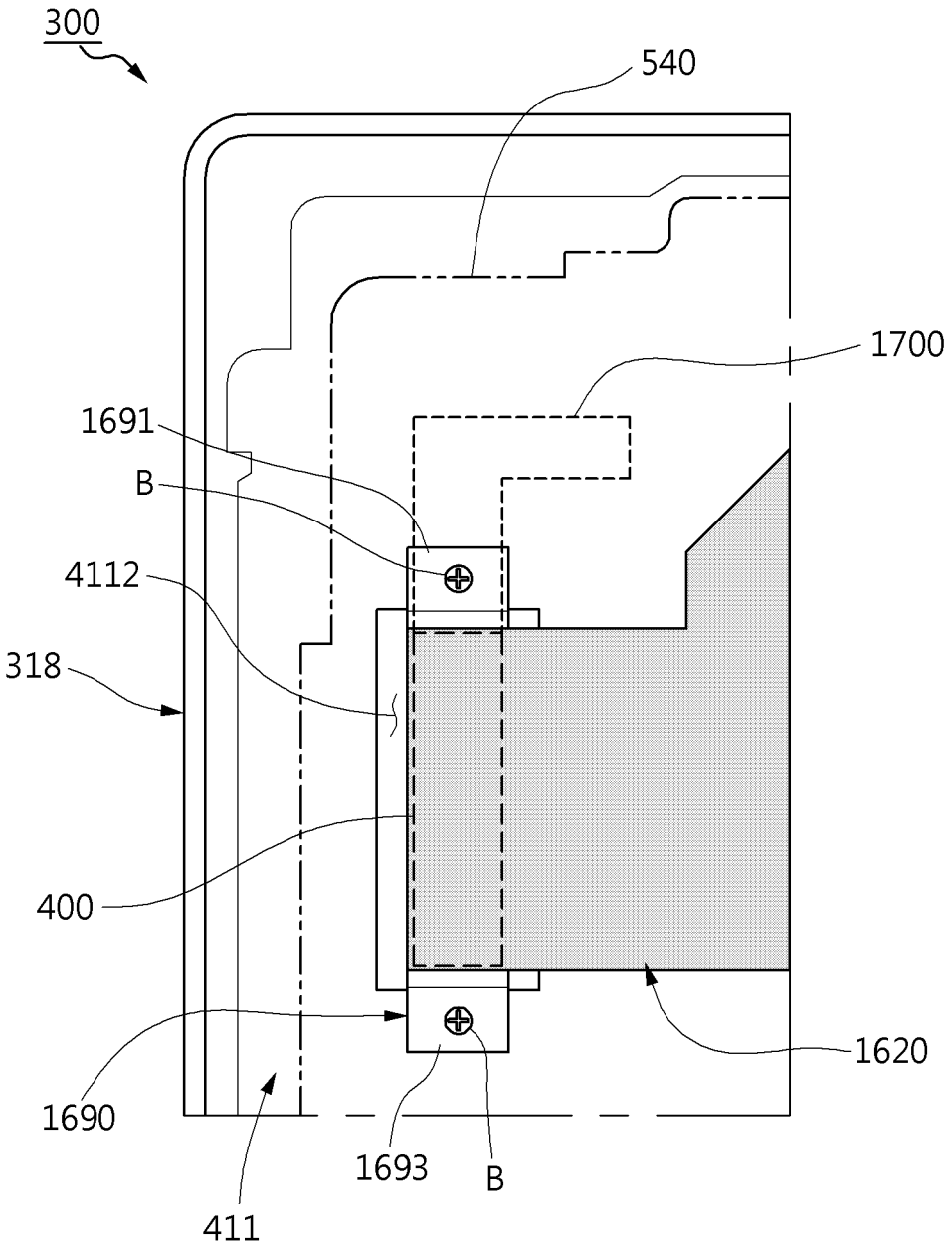
FIG. 17 is a plan view illustrating the electronic device of FIG. 16 according to an embodiment.

FIG. 16 is a cross-sectional view taken along line A-A' in the electronic device 300 of FIG. 3A according to an embodiment. FIG. 17 is a plan view illustrating the electronic device 300 of FIG. 16 according to an embodiment.

Referring to FIGS. 16 and 17, in an example embodiment, the electronic device 300 may include a front plate 302, rear plate 311, side member 318, first support member 411, third support member 461, display 301, antenna module 400, second support member 1690, second printed circuit board 540, heat transfer material 1610, thermally conductive member 1620, metal cover 1630, and/or flexible printed circuit board 1700. According to various embodiments, in FIG. 16, repeated descriptions of components identical or similar to those of reference numerals of FIG. 5 may not be repeated here. According to various embodiments, a structure related to at least some of the components of FIG. 5 may be applied to the electronic device 300 of FIG. 16.

According to an embodiment, the display 301 may be disposed between the first support member 411 and the front plate 302 and be coupled to the front plate 302. An optical transparent adhesive member 560 may be disposed between the front plate 302 and the display 301. The display 301 may include a first layer 510 and a second layer 520 bonded to the first layer 510. The first layer 510 may include a light emitting layer 511 including a plurality of pixels based on a light emitting element. The first layer 510 may include an optical layer 512 (e.g., circular polarization layer) disposed between the light emitting layer 511 and the optical transparent adhesive member 560.

According to an embodiment, the second layer 520 may include a plurality of layers 520-1, . . . , **520-*n* (n≥2) for various functions. The plurality of layers 520-1, . . . , 520-*n* may include, for example, an emboss layer, cushion layer, digitizer, graphite sheet, or copper sheet based on a PET film disposed sequentially in the −z axis direction. According to various embodiments, a plurality of layers included in the first layer 510 or the second layer 520, a stacking structure or a stacking order thereof may be various. According to various embodiments, some (e.g., digitizer) of a plurality of layers of the display 301** may be omitted.

According to an embodiment, the second layer 520 may include a first opening 5201. Due to the first opening 5201, the display 301 may include a recess 5202 of a dug shape in a direction advancing from the rear plate 311 to the front plate 302. The antenna module 400 may be inserted and disposed in the first opening 5201 of the second layer 520. The antenna module 400 may be disposed at a separation distance from the first layer 520.

According to an embodiment, the antenna module 400 may include an antenna structure 800 including a first printed circuit board in which an antenna array (e.g., the antenna 248 of FIG. 2) is disposed. The antenna structure 800 may include an antenna array disposed on the first surface 811, or inside the first printed circuit board closer to the first surface 811 than the second surface 812 (see FIG. 9). The first surface 811 may not overlap the second layer 520 of the display 301 because of the first opening 5201 when viewed from above the front plate 302. The first opening 5201 is disposed to enable a conductive material included in the second layer 520 not to face the antenna array disposed on the first surface 811 or near the first surface 811 to reduce decrease in a radiation performance.

According to an embodiment, the antenna module 400 may be disposed at the second support member 1690 that can replace the second support member 490 of FIG. 4 or 5. The second support member 1690 may include a second portion 1692 in which the antenna module 400 is disposed, and a first portion 1691 and a third portion 1693 extended from the second portion 1692 and coupled with the first support member 411. The antenna module 400 may be attached to the second portion 1692 through a bonding material 580 between the first layer 510 of the display 301 and the second portion 1692 of the second support member 490. The bonding material 580 may be disposed between the second portion 1692 and the first wireless communication circuit 830 in the form of a chip.

According to an example embodiment, the first portion 1691 and/or the third portion 1693 of the second support member 1690 may be coupled to the first support member 411. For example, the first portion 1691 and/or the third portion 1693 may be coupled to one surface of the first support member 411 facing the rear plate 311 through the bolt B. The first portion 1691 and the third portion 1693 may be disposed opposite each other. Thereby, the second support member 1690 may be disposed on the first support member 411 without shaking or sagging against external impacts or loads; thus, a separation distance (e.g., air gap G) between the first surface 811 of the antenna module 400 and the first layer 510 of the display 301 may be maintained.

According to an example embodiment, the second portion 1692 may be formed in a flat shape substantially parallel to the antenna structure 800. When the second support member 1690 in which the antenna module 400 is disposed is coupled to the first support member 411, the antenna module 400 may be disposed to face at a preset separation distance (e.g., a separation distance in consideration of a tolerance so as to secure a radiation performance) from the first layer 510 of the display 301 through the second opening 4112 of the first support member 411 and the recess 5202 of the display 301. According to an example embodiment, the second support member 1690 may be formed with a plate made of various metals such as SUS to be substantially rigid. The second support member 1690 may be implemented with various other materials.

According to various embodiments, the second portion 1692 of the second support member 1690 may be disposed closer to the first layer 510 of the display 301, compared with the first portion 1691 and/or the third portion 1693. The second support member 1690 may include a fourth portion 1694 between the first portion 1691 and the second portion 1692, and the fourth portion 1694 may be formed in an shape inclined to the first portion 1691 or the second portion 1692. The second support member 1690 may include a fifth portion 1695 between the third portion 1693 and the second portion 1692, and the fifth portion 1695 may be formed in a form inclined to the third portion 1693 or the second portion 1692.

According to some embodiments (not illustrated), in order to dispose the antenna module 400 at a preset separation distance (e.g., a separation distance in consideration of a tolerance so as to secure a radiation performance) from the first layer 510 of the display 301, the fourth portion 1694 and/or the fifth portion 1695 of the second support member 1690 may be implemented flat. According to some embodiments (not illustrated), the fourth portion 1694 and/or the fifth portion 1695 of the second support member 1690 may be implemented to be inclined toward the rear plate 311.

According to an embodiment, the second printed circuit board 540 may be seated on the first support member 411 to cover at least a portion of the second support member 1690. The second printed circuit board 540 may be coupled to the first support member 411 through a fastening element such as a bolt B. When viewed from above the rear plate 311, the second printed circuit board 540 may cover at least a portion of the second support member 1690. According to various embodiments (not illustrated), the first portion 1691 and/or the third portion 1693 of the second support member 1690 may be coupled to the first support member 411 together with the second printed circuit board 540 through the bolt B. According to some embodiments (not illustrated), the first portion 1691 and/or the third portion 1693 of the second support member 1690 may be attached to the second printed circuit board 540 through a bonding material such as a solder between the first support member 411 and the second printed circuit board 540. According to some embodiments (not illustrated), the antenna module 400 may be attached or electrically connected to the second printed circuit board 540 through a bonding material. In this case, the second support member 1690 may be omitted, and a position of the thermally conductive member 1620 may vary. For example, the thermally conductive member 1620 may be disposed to avoid the antenna module 400 or may be disposed to cover at least a portion of the antenna module 400.

According to an example embodiment, the thermally conductive member 1620 may be extended between the antenna module 400 and the second printed circuit board 540. For example, the thermally conductive member 1620 may be extended between the second printed circuit board 540 and the second support member 1690. For another example (not illustrated), the thermally conductive member 1620 may be extended between the second support member 1690 and the antenna module 400. According to various embodiments, the thermally conductive member 1620 may be variously positioned in consideration of a disposition relationship between the antenna module 400 and the second printed circuit board 540. The thermally conductive member 1620 may include, for example, a heat pipe or a heat spreader as a heat dissipation structure. According to various embodiments, the thermally conductive member 1620 may be implemented into various heat dissipation sheets such as a graphite sheet. A heat dissipated from various components disposed at the second printed circuit board 540 may be moved to the thermally conductive member 1620.

For example, because of a component that consumes a lot of current such as a processor (e.g., the processor 120 of FIG. 1 such as an application processor (AP)) disposed at the second printed circuit board 540, a communication module (e.g., the communication module 190 of FIG. 1), or a charging module (e.g., the power management module 188 of FIG. 1), or current consumption in the component, a heat may generate in the battery (e.g., the battery 189 of FIG. 1). The thermally conductive member 1620 may distribute a heat generated inside the electronic device 300 so as not to be concentrated in one place. According to various embodiments, the thermally conductive member 1620 may be implemented into a movement path of various heats based on a phenomenon in which a heat flows from a high temperature portion to a low temperature portion. The thermally conductive member 1620 may be extended from between the first support member 411 and the second printed circuit board 540 to between the first support member 411 and the third printed circuit board. The third printed circuit board may be included in the second substrate assembly 442 of FIG. 4. The thermally conductive member 1620 may be disposed across the battery 450 of FIG. 4 when viewed from above the rear plate 311. The thermally conductive member 1620 may enable a heat dissipated from the first substrate assembly 441 of FIG. 4 to flow to the second substrate assembly 442 of FIG. 4.

In various embodiments (not illustrated), referring to FIG. 4, the second printed circuit board 540 of the first substrate assembly 441 may be implemented to have a protruding portion extended between the side member 318 (e.g., the first side portion 701 or the second side portion 702 of FIG. 7A) and the battery 450. In this case, a size of the battery 450 may be partially reduced in the x-axis direction. According to various embodiments, a cable for electrically connecting the protruding portion and a third printed circuit board of the second substrate assembly 462 or an electrical path such as an FPCB may be disposed between the side member 318 (e.g., the first side portion 701 or the second side portion 702 of FIG. 7A) and the battery 450. In this case, the thermally conductive member 1620 may be extended between the side member 318 (e.g., the first side portion 701 or the second side portion 702 of FIG. 7A) and the battery 450, when viewed from above the rear plate 311. The thermally conductive member 1620 may be disposed to overlap the second printed circuit board 540 and the third printed circuit board when viewed from above the rear plate 311. The thermally conductive member 1620 may not overlap the battery 450 when viewed from above the rear plate 311.

In various embodiments (not illustrated), referring to FIG. 4, instead of the second printed circuit board 540 of the first substrate assembly 441 and the third printed circuit board of the second substrate assembly 442, an one-piece printed circuit board may be provided. Referring to FIGS. 4 and 7A, an one-piece printed circuit board may include a first portion disposed between the third side portion 703 and the battery 450, a second portion disposed between the fourth side portion 704 and the battery 450, and a third portion disposed between the first side portion 701 (or the second side portion 702) and the battery 450 and connecting the first portion and the second portion. For the third portion, a size of the battery 450 may be partially reduced in the x-axis direction. The thermally conductive member 1620 may be extended between the side member 318 (e.g., the first side portion 701 or the second side portion 702 of FIG. 7A) and the battery 450, when viewed from above the rear plate 311. The thermally conductive member 1620 may be disposed to overlap with the one-piece printed circuit board, when viewed from above the rear plate 311. The thermally conductive member 1620 may not overlap the battery 450 when viewed from above the rear plate 311.

According to various embodiments, the metal cover 1630 may cover at least a portion of components disposed at the second printed circuit board 540 between the first support member 411 and the second printed circuit board 540. The metal cover 1630 may serve to shield noise and be referred to as, for example, a shield can. Noise generated from components such as the antenna module 400 may be shielded by the metal cover 1630 not to be introduced into components disposed at the second printed circuit board 540. Noise generated from components disposed at the second printed circuit board 540 may be shielded by the metal cover 1630 not to be transmitted to peripheral components such as the antenna module 400. According to an embodiment, the thermally conductive member 1620 may be extended between the metal cover 1630 and the second support member 1690 and contact the metal cover 1630. A heat dissipated from components disposed at the second printed circuit board 540 may be moved to the thermally conductive member 1620 seated on the metal cover through the metal cover 1630 to be spread or dispersed from the thermally conductive member 1620. The second substrate assembly 442 of FIG. 4 may include a metal cover that covers at least a portion of the third printed circuit board, and the thermally conductive member 1620 may be extended to the second substrate assembly 442 to contact the metal cover.

According to an example embodiment, the heat transfer material 1610 may be disposed between the second support member 1690 (e.g., the second portion 1692) and the thermally conductive member 1620. A heat radiated from the antenna module 400 (e.g., the first wireless communication circuit 830) may move to the thermally conductive member 1620 through the heat transfer material 1610. The heat transfer material 1610 may include various materials (e.g., polymer) having high thermal conductivity, such as a thermal interface material (TIM).

According to various embodiments, the bonding material 580 between the antenna module 400 and the second support member 490 may include a heat transfer material. At least a portion of a heat dissipated from the antenna module 400 may move to the second support member 490 through a bonding material. According to various embodiments, various heat transfer paths (or media) or heat transfer structures for moving a heat dissipated from the antenna module 400 to the heat conductive member 1620 may be provided.

According to an example embodiment, the flexible printed circuit board 1700 (see FIG. 17) may electrically connect the antenna module 400 and the second printed circuit board 540. A connector (not illustrated) disposed at one end of the flexible printed circuit board 1700 may be electrically connected to a connector (not illustrated) disposed at the second printed circuit board 540 between the first support member 411 and the second printed circuit board 540. According to some embodiments (not illustrated), the flexible printed circuit board 1700 may be electrically connected to the second printed circuit board 540 in the same manner as the flexible printed circuit board 1400 of FIG. 15.

According to an example embodiment of the disclosure, an electronic device (e.g., the electronic device 300 of FIG. 5) may include: a housing (e.g., the housing 310 of FIG. 3A) including a front plate (e.g., the front plate 302 of FIG. 5), a rear plate (e.g., the rear plate 311 of FIG. 5) disposed opposite the front plate, and a side bezel (e.g., the side member 318 of FIG. 5) enclosing at least a portion of a space between the front plate and the rear plate. The electronic device may include a display (e.g., the display 301 of FIG. 5) disposed in the space and visible through at least a portion of the front plate. The display may include a first layer (e.g., the first layer 510 of FIG. 5 or 6) including a plurality of pixels. The display may include a second layer (e.g., the opening 520 of FIG. 5 or 6) disposed at the first layer and including an opening (e.g., the opening 5201 of FIG. 5 or 6). The electronic device may include an antenna module (e.g., the antenna module 400 of FIG. 5 or 6) disposed in the space. The antenna module may include a printed circuit board (e.g., the antenna structure 800 of FIG. 5) including a first surface (e.g., the first surface 811 of FIG. 5 or 8) facing away from the first layer through the opening and a second surface (e.g., the second surface 812 of FIG. 9) facing opposite the first surface. The antenna module may include at least one antenna element (e.g., the plurality of antenna elements 821, 822, 823, and 824 of FIG. 8) disposed on the first surface 811, or inside the printed circuit board closer to the first surface than the second surface. The antenna module may include a communication circuit (e.g., the communication circuit 830 of FIG. 5) disposed at the second surface and configured to transmit and/or receive signals of a selected or designated frequency band through the at least one antenna element.

According to an example embodiment of the disclosure, the communication circuit (e.g., the communication circuit 830 of FIG. 5) may be configured to form a beam pattern toward the front plate (e.g., the front plate 302 of FIG. 5) through the at least one antenna element (e.g., the plurality of antenna elements 821, 822, 823, and 824 of FIG. 8).

According to an example embodiment of the disclosure, the selected or designated frequency band may include a range of 6 GHz to 100 GHz or a range of 24 GHz or more.

According to an example embodiment of the disclosure, the at least one antenna element may include an antenna array (e.g., the antenna array 820 of FIG. 8) having a plurality of antenna elements.

According to an example embodiment of the disclosure, the plurality of antenna elements (e.g., the plurality of antenna elements 821, 822, 823, and 824 of FIG. 8) may include a patch antenna or a dipole antenna.

According to an example embodiment of the disclosure, the second layer (e.g., the second layer 520 of FIG. 5 or 6) may include at least one of a material that shields light, a material that absorbs or shields electromagnetic waves, or a material that diffuses a heat.

According to an example embodiment of the disclosure, the first surface (e.g., the first surface 811 of FIG. 5) may be disposed in the opening (e.g., the opening 5201 of FIG. 5).

According to an example embodiment of the disclosure, the first surface (e.g., the first surface 811 of FIG. 5) may be disposed outside the opening (e.g., the opening 5201 of FIG. 5).

According to an example embodiment of the disclosure, the electronic device may further include: a first support (e.g., the first support member 411 of FIG. 5) disposed in the space and connected to the side bezel (e.g., the side member 318 of FIG. 5) or integrally formed with the side bezel. The electronic device may further include a second support (e.g., the second support member 490 of FIG. 5) connecting the support first support and the antenna module (e.g., the antenna module 400 of FIG. 5).

According to an example embodiment of the disclosure, the second support (e.g., the second support member 490 of FIG. 5) may include at least one first portion (e.g., the first portion 491 of FIG. 5 or the first portion 1691 and/or the third portion 1693 of FIG. 16) coupled with the first support (e.g., the first support member 411 of FIG. 5), and a second portion (e.g., the second portion 492 of FIG. 5 or the second portion 1692 of FIG. 6) extending from the first portion and in which the antenna module (e.g., the antenna module 400 of FIG. 5) is disposed.

According to an example embodiment of the disclosure, the first support (e.g., the first support member 411 of FIG. 5) may include a second opening (e.g., the second opening 4112 of FIG. 5) at least partially overlapping the opening (e.g., the first opening 5201 of FIG. 5) of the second layer (e.g., the second layer 520 of FIG. 5), when viewed from above the front plate (e.g., the front plate 302 of FIG. 5). The antenna module (e.g., the antenna module 400 of FIG. 5) may be inserted into the second opening.

According to an example embodiment of the disclosure, the second portion (e.g., the second portion 492 of FIG. 5 or the second portion 1692 of FIG. 16) may be disposed closer to the display (e.g., the display 301 of FIG. 5) than the first portion (e.g., the first portion 491 of FIG. 5, the first portion 1691 or the third portion 1693 of FIG. 16).

According to an example embodiment of the disclosure, the second support (e.g., the second support member 490 of FIG. 5) may comprise a thermally conductive material. The electronic device may further include a thermally conductive bonding material (e.g., the bonding material 580 of FIG. 5) disposed between the second portion (e.g., the second portion 492 of FIG. 5 or the second portion 1692 of FIG. 16) and the antenna module (e.g., the antenna module 400 of FIG. 5).

According to an example embodiment of the disclosure, the electronic device may further include a thermally conductive member (e.g., the thermally conductive member 1300 of FIG. 13 or the thermally conductive member 1620 of FIG. 16) disposed to overlap the antenna module (e.g., the antenna module 400 of FIG. 5), when viewed from above the front plate (e.g., the front plate 302 of FIG. 5), in the space.

According to an example embodiment of the disclosure, the thermally conductive member may include a heat pipe or a heat spreader.

According to an example embodiment of the disclosure, the electronic device may further include a heat pipe or a heat spreader (e.g., the heat dissipation structure 1305 of FIG. 13) connected to the thermally conductive member (e.g., the thermally conductive member 1300 of FIG. 13).

According to an example embodiment of the disclosure, an electronic device (e.g., the electronic device 300 of FIG. 5) may include: a housing (e.g., the housing 310 of FIG. 3A) including a front plate (e.g., the front plate 302 of FIG. 5), a rear plate (e.g., the rear plate 311 of FIG. 5) disposed opposite the front plate, and a side bezel (e.g., the side member 318 of FIG. 5) enclosing at least a portion of a space between the front plate and the rear plate. The electronic device may include a display (e.g., the display 301 of FIG. 5) disposed in the space and visible through at least a portion of the front plate. The display may include a first layer (e.g., the first layer 510 of FIG. 5 or 6) including a plurality of pixels. The display may include a second layer (e.g., the second layer 520 of FIG. 5 or 6) disposed at the first layer and including an opening (e.g., the first opening 5201 of FIG. 5 or 6). The electronic device may include an antenna module (e.g., the antenna module 400 of FIG. 5 or 6) disposed in the space. The antenna module may include a printed circuit board (e.g., the antenna structure 800 of FIG. 5 or 8) including a first surface (e.g., the first surface 811 of FIG. 5 or 8) facing away from the first layer through the opening and a second surface (e.g., the second surface 812 of FIG. 9) facing opposite the first surface. The antenna module may include at least one antenna element (e.g., the plurality of antenna elements 821, 822, 823, and 824 of FIG. 8) disposed on the first surface 811, or inside the printed circuit board closer to the first surface than the second surface, the antenna element configured to form a beam pattern toward the front plate. The antenna module may include a communication circuit (e.g., the communication circuit 830 of FIG. 5) disposed at the second surface and configured to transmit and/or receive signals of a selected or designated frequency band through the at least one antenna element. The electronic device may include a thermally conductive member (e.g., the thermally conductive members 1300 and 1305 of FIG. 13 or the thermally conductive member 1620 of FIG. 16) disposed in the space and connected to the antenna module.

According to an example embodiment of the disclosure, the thermally conductive member may include a heat pipe or a heat spreader.

According to an example embodiment of the disclosure, the electronic device may further include a first support (e.g., the first support member 411 of FIG. 5) disposed in the space and connected to the side bezel (e.g., the side member 318 of FIG. 5) or integrally formed with the side bezel. The electronic device may include a second support (e.g., the second support member 490 of FIG. 5 or the second support member 1690 of FIG. 16) connecting the first support and the antenna module (e.g., the antenna module 400 of FIG. 5). The second support may include at least one first portion (e.g., the first portion 491 of FIG. 5 or the first portion 1691 and/or the third portion 1693 of FIG. 16) coupled with the first support, and a second portion (e.g., the second portion 492 of FIG. 5 or the second portion 1692 of FIG. 16) extending from the first portion and in which the antenna module is disposed. The thermally conductive member may extend between the second portion and the antenna module.

According to an example embodiment of the disclosure, the first support (e.g., the first support member 411 of FIG. 5) may include a second opening (e.g., the second opening 4112 of FIG. 5) at least partially overlapping the opening (e.g., the first opening 5201 of FIG. 5) of the second layer (e.g., the second layer 520 of FIG. 5 or 6), when viewed from above the front plate (e.g., the front plate 302 of FIG. 5). The antenna module (e.g., the antenna module 400 of FIG. 5 or 6) may be inserted into the second opening.

According to an example embodiment of the disclosure, because an antenna module can transmit and/or receive radio waves by radiating energy toward a front surface of an electronic device in which a display is disposed, coverage toward the front surface can be secured.

Further, effects that can be obtained or predicted because of various example embodiments of the disclosure are disclosed directly or implicitly in the detailed description.

While the disclosure has been illustrated and described with reference to various example embodiments thereof, it will be understood that the various example embodiments are intended to be illustrative, not limiting. It will be further understood by one of ordinary skill in the art that various changes in form and detail may be made without departing from the true spirit and full scope of the disclosure, including the appended claims and their equivalents.

What is claimed is:

1. An electronic device, comprising:

a housing comprising a front plate, a rear plate disposed opposite the front plate, and a side bezel enclosing at least a portion of a space between the front plate and the rear plate;

a display disposed in the space and visible through at least a portion of the front plate, wherein the display comprises:

a first layer comprising a plurality of pixels; and a second layer disposed at the first layer and comprising an opening; and an antenna module disposed in the space, wherein the antenna module comprises:

a printed circuit board comprising a first surface facing away from the first layer through the opening and a second surface facing opposite the first surface;

at least one antenna element disposed on the first surface, or inside the printed circuit board closer to the first surface than the second surface; and a communication circuit disposed at the second surface of the printed circuit board, the communication circuit configured to transmit and/or receive signals of a selected or designated frequency band through the at least one antenna element.

2. The electronic device of claim 1, wherein the communication circuit is configured to form a beam pattern toward the front plate through the at least one antenna element.

3. The electronic device of claim 1, wherein the selected or designated frequency band is in a range of 6 GHZ to 100 GHz.

4. The electronic device of claim 1, wherein the at least one antenna element comprises an antenna array having a plurality of antenna elements.

5. The electronic device of claim 4, wherein the plurality of antenna elements comprise a patch antenna or a dipole antenna.

6. The electronic device of claim 1, wherein the second layer comprises at least one of a material that shields light, a material that absorbs or shields electromagnetic waves, or a material that diffuses heat.

7. The electronic device of claim 1, wherein the first surface is disposed inside the opening.

8. The electronic device of claim 1, wherein the first surface is disposed outside the opening.

9. The electronic device of claim 1, further comprising:
a first support disposed in the space and connected to the side bezel or integrally formed with the side bezel; and
a second support connecting the first support and the antenna module.

10. The electronic device of claim 9, wherein the second support comprises at least one first portion coupled with the first support, and a second portion extending from the first portion and in which the antenna module is disposed.

11. The electronic device of claim 10, wherein the first support comprises a second opening at least partially overlapping the opening of the second layer, when viewed from above the front plate, and
the antenna module is disposed in the second opening.

12. The electronic device of claim 11, wherein the second portion is disposed closer to the display than the first portion.

13. The electronic device of claim 10, wherein the second support comprises a thermally conductive material, and further comprises a thermally conductive bonding material disposed between the second portion and the antenna module.

14. The electronic device of claim 1, further comprising a thermally conductive member comprising a thermally conductive material disposed to overlap the antenna module, when viewed from above the front plate, in the space.

15. The electronic device of claim 14, wherein the thermally conductive member comprises a heat pipe or a heat spreader.

16. The electronic device of claim 14, further comprising a heat pipe or a heat spreader connected to the thermally conductive member.

17. An electronic device, comprising:
a housing comprising a front plate, a rear plate disposed opposite the front plate, and a side bezel enclosing at least a portion of a space between the front plate and the rear plate;
a display disposed in the space and visible through at least a portion of the front plate,
wherein the display comprises:
a first layer comprising a plurality of pixels; and
a second layer disposed at the first layer and comprising an opening;
an antenna module disposed in the space,
wherein the antenna module comprises:
a printed circuit board comprising a first surface facing away from the first layer through the opening and a second surface facing opposite the first surface;
at least one antenna element disposed on the first surface, or inside the printed circuit board closer to first surface than the second surface, the at least one antenna element configured to form a beam pattern toward the front plate;
a communication circuit disposed at the second surface and configured to transmit and/or receive signals of a selected or designated frequency band through the at least one antenna element; and
a thermally conductive member comprising a thermally conductive material disposed in the space and connected to the antenna module.

18. The electronic device of claim 17, wherein the thermally conductive member comprises a heat pipe or a heat spreader.

19. The electronic device of claim 17, further comprising:
a first support disposed in the space and connected to the side bezel or integrally formed with the side bezel; and
a second support connecting the first support and the antenna module,
wherein the second support comprises:
at least one first portion coupled with the first support, and a second portion extending from the first portion and in which the antenna module is disposed, and
wherein the thermally conductive member extends between the second portion and the antenna module.

20. The electronic device of claim 19, wherein the first support comprises a second opening at least partially overlapping the opening of the second layer, when viewed from above the front plate, and
the antenna module is disposed in the second opening.

* * * * *